US010413461B1

(12) United States Patent
Golden, Jr.

(10) Patent No.: US 10,413,461 B1
(45) Date of Patent: Sep. 17, 2019

(54) UNILATERAL TRANSITION MEANS FOR ADAPTING A WHEELCHAIR

(71) Applicant: Stephen C. Golden, Jr., Menasha, WI (US)

(72) Inventor: Stephen C. Golden, Jr., Menasha, WI (US)

( * ) Notice: Subject to any disclaimer, the term of this patent is extended or adjusted under 35 U.S.C. 154(b) by 157 days.

(21) Appl. No.: 15/724,210

(22) Filed: Oct. 3, 2017

Related U.S. Application Data

(63) Continuation of application No. 14/314,030, filed on Jun. 25, 2014, now Pat. No. 9,808,384.

(51) Int. Cl.
*A61G 5/10* (2006.01)
*A61G 5/02* (2006.01)
*A61G 5/06* (2006.01)

(52) U.S. Cl.
CPC ..... *A61G 5/10* (2013.01); *A61G 5/02* (2013.01); *A61G 5/06* (2013.01); *A61G 5/1054* (2016.11); *A61G 5/1083* (2016.11)

(58) Field of Classification Search
CPC ... A61G 5/02; A61G 5/06; A61G 5/10; A61G 5/1054; A61G 5/1083
USPC ..... 280/304.1
See application file for complete search history.

(56) References Cited

U.S. PATENT DOCUMENTS 3,137,276 A 6/1964 Weisser
3,170,362 A 2/1965 Mewse
3,192,820 A 7/1965 Pitzer
3,318,289 A 5/1967 Marynissen
4,132,423 A 1/1979 Chant
4,316,616 A 2/1982 Boivin
4,511,157 A 4/1985 Wilt, Jr.
5,273,304 A 12/1993 Berkheimer
5,280,937 A * 1/1994 Needham ..... A61G 5/023 280/259
6,311,999 B1 11/2001 Kueschall
7,261,309 B2 8/2007 Watwood
7,520,518 B2 4/2009 Peterson
7,735,847 B2 6/2010 Dougherty
7,766,342 B2 8/2010 Fast
8,152,192 B2 * 4/2012 Dougherty ..... A61G 5/1089 280/304.1
8,348,293 B1 1/2013 Lasher
8,414,008 B2 4/2013 Hay
8,573,622 B2 11/2013 Papi
8,585,071 B2 11/2013 Golden, Jr.
8,613,350 B2 12/2013 Nease, III
8,651,507 B2 2/2014 Kylstra
8,684,113 B1 4/2014 Laconis
2007/0096427 A1 5/2007 Knaub
2011/0099857 A1 5/2011 Thomas
2013/0009372 A1 1/2013 Willis
(Continued)

FOREIGN PATENT DOCUMENTS

DE 4107410 A1 * 9/1991 ..... A61G 5/023
FR 2841462 A1 1/2004
(Continued)

*Primary Examiner* — Jacob D Knutson
*Assistant Examiner* — Felicia L. Brittman

(57) ABSTRACT

Transition means for adapting a wheelchair are disclosed wherein a user or an occupant of the wheelchair is enabled to repeatably alternate the wheelchair between an original mode and an adapted mode by engaging and disengaging a unilaterally-connected adaptive implement.

20 Claims, 11 Drawing Sheets

(56) References Cited

U.S. PATENT DOCUMENTS

| | | | |
|---|---|---|---|
| 2015/0001833 | A1 | 1/2015 | Golden, Jr. |
| 2016/0151215 | A1 | 6/2016 | Golden, Jr. |
| 2017/0172822 | A1 | 6/2017 | Golden, Jr. |

FOREIGN PATENT DOCUMENTS

| | | | | | |
|---|---|---|---|---|---|
| WO | WO-2010139507 | A1 * | 12/2010 | ..... | A61G 5/06 |
| WO | WO-2011153585 | A1 * | 12/2011 | ..... | A61G 5/02 |

* cited by examiner

UNILATERAL TRANSITION MEANS FOR ADAPTING A WHEELCHAIR

CROSS-REFERENCE TO RELATED APPLICATION

This application claims priority to, and is a continuation of, U.S. patent application Ser. No. 14/314,030, "Unilateral Transition Means for Adapting a Wheelchair," filed Jun. 25, 2014, which is hereby incorporated by reference in its entirety for all purposes.

BACKGROUND OF THE INVENTION

1. Field of the Invention

This invention relates to wheelchairs, related devices, and methods for use, particularly for transportation.

2. Description of Related Art

The wheelchair is a common means of daily mobility for individuals with partial or complete impairment of sensory and motor function. As an alternative to walking, running, standing, kneeling, or crouching to move about in the physical environment or to enact change thereto, the wheelchair itself serves as a suitable, although limited, mobility means.

For many people, the wheelchair serves as an essential conveyance and for performing common activities that would otherwise be difficult, if not impossible, such as moving about in one's home, going shopping at the store, attending public gatherings, tending to a garden, and playing at the park with one's own children or grandchildren. For some, such activities may be performed independently, while for others considerable assistance may be necessary; the wheelchair is thus useful in both the context of independent mobility and in that of assistive transportation of a person with a disability. Whereas the wheelchair has traditionally been viewed as an object of confinement, advances in wheelchair technology, improved accessibility standards, and increasingly open-minded attitudes regarding the topic of disability have elevated the wheelchair as a tool for health, personal enjoyment and freedom.

Individuals who utilize wheelchairs for their daily mobility typically do so under the direction of physicians, licensed physical therapists, and other clinicians who are well-versed in the practice of compensating for physical disabilities through the use of adaptive mobility devices. Ideally, clinicians also educate and encourage their patients to engage in physical activity, to the greatest extent that their abilities will allow, for the sake of their overall well-being. Such physical activity helps to maintain cardiovascular health, muscle strength and endurance, flexibility, and range of motion. Additionally, ideal clinical practices emphasize the independence and safety of the individual, looking at his or her day-to-day activities in the home, in the neighborhood, and in the surrounding community.

Manually-propelled wheelchairs, from a holistic health standpoint, are preferred over motorized wheelchairs, the latter which, in many cases, contributes to a downward spiral of deconditioning during which the user's cardiovascular health, muscle strength and endurance, flexibility and range of motion all decline and thus reduce the user's overall health and independence. Manually-propelled wheelchairs require an occupant to exert his or her own upper body strength to transfer muscle-derived force to at least one of two rear drive wheels of the wheelchair to impart movement of the wheelchair in a desired direction of travel. In the process, the user experiences the benefits of physical exercise and maintains the aforementioned aspects of an active and healthy lifestyle.

Manually-propelled wheelchairs, nevertheless, possess limitations with regard to their suitability for the broad and heterogeneous range of physical environments which people regularly encounter as they alternate between indoor and outdoor spaces, or as they come upon a ground surface with a different texture as compared with that previously being traversed. Different kinds of surfaces, whether they be carpet or hard-wood flooring, concrete streets, sidewalks, gravel or dirt pathways, grassy fields, or sandy beaches, for example, all impose different challenges requiring different levels of strength and different kinds of maneuvering. The marked disparity between a flat, smooth parking lot and a trail layered with sand, gravel, and loose woodchips (all which might be encountered during the same visit to a local, state, or federal park) presents a physically demanding situation which may discourage some wheelchair users and their families from fully enjoying such public resources or which may put the individual at risk for injury due to the significant exertion, strain, and imbalance he or she may experience.

Common to manually-propelled wheelchairs is at least one forward pivotable caster assembly comprising a smaller diameter wheel which, as a result of having a wheel rotational axis disposed rearward relative to a vertical pivot axis of the caster assembly, causes the entire caster assembly to passively assume an orientation of forward travel while the wheelchair is motivated in the forward direction. As the wheelchair is motivated in other directions, such as to the side or in reverse, the forward pivotable caster assembly will passively pivot and the caster wheel will passively rotate such that the wheelchair may be freely maneuvered in all directions of travel. The freedom with which the caster assembly pivots and the wheel rotates is why pivotable casters are ubiquitous in wheelchair design, and the correct functioning of a caster assembly depends on factors such as the geometry and size of the caster assembly, the diameter and width of the caster wheel, and the traction of the caster wheel as it rolls over the ground surface.

Further, the utility of the caster assembly depends largely on the extent to which it bears the weight of the front end of the wheelchair and how successfully it carries this weight smoothly over the ground surface. In situations during which the caster sinks into the ground surface, such as on sand, snow, or gravel, the caster may be rendered useless and may even prove to be dangerous. Generally, the larger and wider the caster wheel, the better the weight distribution and the more readily it will roll over the ground surface. As most manually-propelled wheelchairs comprise a pair of forward pivotable caster assemblies, if they are not optimally suited to the terrain, such a pair can be even more problematic at times when one caster wheel is engaged with the ground surface and the other is not, in that the overall wheelbase of the wheelchair while traversing a rough or uneven surface is compromised and the user may lose balance and fall out of the wheelchair.

On the other hand, if a wheelchair is fitted with very large caster wheels, the maneuverability of the wheelchair will suffer when the user is faced with negotiating tight spaces requiring sharp turns, such as in kitchens, bedrooms, bathrooms, elevators, and office spaces. Thus, a forward pivotable caster assembly having a more petite structure, comprising a smaller caster wheel, and disposed closer to the rear wheels, longitudinally speaking, will prove to be best adapted for indoor use; this stands in stark contrast with the optimum caster arrangement for outdoor use which favors a larger robust caster assembly comprising a larger caster wheel and disposed on the wheelchair in a way that, instead, maximizes the longitudinal wheelbase for greater forward stability.

The contrast between indoor floor surfaces and outdoor terrain may vary depending on seasonal factors such as rain and snowfall, which significantly impact traction; this may be further influenced by the frequency of efforts, or lack thereof, to maintain and clear roadways, sidewalks, and driveways. For example, urban residences may benefit from prompt snow removal and de-icing services, whether by public services or by private homeowners' associations, whereas rural neighborhoods or farmsteads, for example, may not have access to such services. A wheelchair user residing rurally may thus experience a more profound contrast between the indoor environment and that of the outdoors.

Transit in urban environments as well as long-distance travel, which may involve transportation in vehicles such as cars, buses, trains, airplanes, watercraft, or larger vessels, require the wheelchair user to adapt to the space allowed inside the vehicle upon boarding and to again adapt to the space outside the vehicle upon arriving at his or her destination. In some situations, such as in the case of a wheelchair user traveling by car, the user may be required to exit or "transfer" out of the wheelchair and into a driver's or passenger's seat, and may be further required to disassemble the wheelchair in order to stow the separable components inside the vehicle. Similar situations may be encountered in the case of a wheelchair user requiring the assistance of a friend, family member, or other attendant, in that the user may need to be lifted out of the wheelchair and into the vehicle and the wheelchair subsequently stowed in a separate area of the vehicle. In other situations, a wheelchair user may desire to board a bus or train and situate herself amongst other passengers. Rather than struggle to maneuver around in the limited space with a large all-terrain caster assembly, and risk bumping into others or posing a trip hazard therefore, it would be preferable for the wheelchair user to quickly detach the adaptive caster assembly or temporarily stow it in an alternate position until the user exits the vehicle and again wishes to utilize it for negotiating rough terrain.

The aforementioned considerations are central to prior and ongoing efforts to develop adaptive devices, which enable a wheelchair user, clinician, caretaker, assistant, or medical staff member to suitably adapt, modify, or convert a wheelchair according to the demands of the physical environment being encountered.

Improved wheelchair adapter designs and methods have been devised which may address one or more of these aforementioned weaknesses or other weaknesses in the prior art. Such weaknesses, however, are mentioned here only for illustrative background purposes. The embodiments hereafter described, while typically addressing one or more weaknesses in the prior art, need not directly or indirectly address all or any of the aforementioned weaknesses in the prior art to be within the scope of the various embodiments hereafter claimed. Further, any advantages stated or apparently inherent to any of the embodiments described hereafter are not intended as limitations that must necessarily be found in any or all aspects of the invention.

SUMMARY OF THE INVENTION

In the context of technology in the art of wheelchairs and attachments therefor, the present invention concerns the problem of wheelchair adaptability and addresses the need for rapid, robust, and versatile means for adapting wheelchairs to enable activities such as those illustrated above. In particular, embodiments of the present invention afford a wheelchair user improved ease, speed, and versatility by enabling the user to willfully engage and disengage at least one adaptive implement that is connected to a portion of the wheelchair that is substantially offset from a central vertical longitudinal plane passing through the wheelchair. In other words, the adaptive implement is attached to a lateral or side portion of the wheelchair and is operated by the user in conjunction with a transition means for alternating the adaptive implement between an operative state and an inoperative state.

Embodiments of the present invention include rigid features for ensuring a strong attachment of an adaptive implement to a wheelchair and stable, play-free performance of all components and all connections therebetween during intended use of the adaptive implement. At the same time, relative movement is permitted between certain elements during willful transition between a load-sharing operative state, during which a load placed upon either the wheelchair or the adaptive implement, or both, is distributed between the wheelchair and the adaptive implement, and a non-load-sharing inoperative state absent any load distribution therebetween. Furthermore, embodiments may include adjustment means for configuring the unified wheelchair and adaptive implement in a manner which, ideally, preserves the essential functionalities of the wheelchair, especially mobility, comfort, and safety, while enabling optimal performance by the occupant during intended use of the adaptive implement.

Embodiments of the present invention enable a user or an occupant of a wheelchair to convert the wheelchair between an original mode and an adapted mode in a novel manner and with advantages not anticipated in the prior art. In the aim of adapting a wheelchair, the advantages of unobtrusiveness, ease of access, and simplicity of operation would be appreciated, collectively or separately, by a person experienced in the art of adaptive wheelchair mobility.

Such advantages, as set forth by embodiments of the present invention, are achieved by exploiting a lateral portion of the wheelchair, which in many wheelchairs, especially in rigid-type "everyday" wheelchairs, is predominantly devoid of structural components and accessories useful to the user. For example, the disclosed structures and frame elements of U.S. Pat. No. 7,520,518, "Wheelchair" issued to Peterson, et al. and U.S. Pat. No. 6,311,999 B1 "Wheelchair with a closed three-dimensional frame" issued to Kueschall, and U.S. Pat. No. 8,573,622 B2 "Wheelchair" issued to Papi, all which are herein incorporated by reference to the extent that they are noncontradictory herewith, may be of use in further understanding these types of wheelchairs and their suitability for use with embodiments of the present invention. Other patents describing various kinds of wheelchairs and architectures thereof may also be useful for appropriately applying the transition means described herein, including those cited herein.

In many cases, the aforementioned lateral region is suitable, spatially and structurally, for accommodating elements necessary for reliable attachment of adaptive devices to robust portions of the wheelchair. This region is also suitable for operation of a transitioning device which enables an occupant of the wheelchair to convert the wheelchair between an original mode and an adapted mode, wherein momentarily reclining the wheelchair effectuates a change in the position of an adaptive implement relative to the wheelchair, and wherein said relative position may be maintained, especially under load-sharing conditions.

Lateral attachment points of the wheelchair offer a very robust and more direct connection to the load-bearing structures of the wheelchair, as opposed to, for example, an attachment means which attaches to the footrest of the wheelchair, such as inventions illustrated by Dougherty in U.S. Pat. No. 8,152,192 B2 "All-terrain adapter for a wheelchair," by Richter in WO 2010/139,507 "Supplementary front wheel device in combination with a frame connecting adapter for four-wheel vehicles, in particular for wheelchairs," and by Herve in FR 2,841,462 A1 "Module de transformation pour fauteuil roulant" (translated: "Module for transforming a wheelchair").

Rather than awkwardly dispose those structures necessary for attachment and for transitioning at a substantially central forward location on the wheelchair, embodiments of the present invention, by virtue of being disposed at a lateral location, instead complement the performance characteristics of the wheelchair—that is, such devices provide for secure, robust attachment while minimally lengthening the wheelchair and minimally altering the wheelchair's center of gravity, subject of course to the length and weight of the adaptive implement being attached.

From an ergonomics point of view, in utilizing a device embodied by the present invention, the user or occupant of the wheelchair benefits from the open space which surrounds the portion of the wheelchair to which the device is attached. The wheelchair occupant does not struggle in reaching to initialize the transitioning means or for attaching and detaching the device, nor does the device compete for space with other structures or immobile parts of the occupant's body, such as his or her feet or legs, in contrast with the aforementioned prior art examples.

By actuating a biasing mechanism, the user or occupant manually pre-disposes or "arms" a load-transfer assembly towards a state opposite the current state. Upon subsequent performance of a wheel-stand maneuver, most commonly referred to as a "wheelie," a moveable bearing element of the load-transfer assembly moves into or out of a position of engagement with a bearing surface. The wheel-stand maneuver involves a quick, controlled motion that is a normal and well-known aspect to everyday wheelchair maneuvering and which is taught, by professionals knowledgeable in adaptive mobility, to many wheelchair users during the early stages of their acclimation to the wheelchair for everyday use.

Upon placing the moveable bearing element is in the position of engagement with the bearing surface, loading on the adapter as a result of the weight of the wheelchair and the occupant, as well as from the weight of the attached adaptive implement, is supported by the union of the moveable bearing element and the bearing surface. As a result, the loading on the unified wheelchair and adaptive implement is distributed therebetween through the load-transfer assembly. Upon removing the moveable bearing element from the position of engagement with the bearing surface or, in other words, moving the moveable bearing element into a position of disengagement from the bearing surface, the adaptive implement is relieved from supporting the loading on the wheelchair. Therefore, through the process of manipulating the biasing mechanism and subsequently performing a wheel-stand maneuver, an adaptive implement connected distally to the load-transfer assembly is willfully alternated by the user or occupant between a load-sharing operative state and a non-load-sharing inoperative state.

In some embodiments, it may be useful to enable the user or occupant to select among a plurality of load-sharing operative states, or it may be useful to enable selection among a plurality of non-load-sharing inoperative states, or both, by moving the moveable bearing element into one of a plurality of useful engagement positions, such as nested grooves or teeth, disposed on the bearing surface. For example, it may be useful for a wheelchair occupant to select whether to transition the load-transfer assembly to a highly-reclined load-sharing operative state in which the wheelchair is reclined backwards to an angle of 6 degrees, or a moderately-reclined load-sharing operative state in which the wheelchair is reclined backwards to an angle of 3 degrees. Alternatively, it may be useful for a wheelchair occupant to transition the load-transfer assembly among a reclined load-sharing operative state, a non-load-sharing non-reclined inoperative state, and a non-load-sharing stowed state which, in the latter state, an adaptive implement is disengaged from the ground surface but remains in a convenient, elevated position to enable the original and unadapted functionality of the wheelchair without requiring the occupant to disconnect the adaptive implement from the wheelchair.

The biasing mechanism may comprise, within a single housing or enclosure, a pluri-state switch or actuator, manipulable by the user or occupant of the wheelchair, in combination with a load-transfer assembly. A relevant example is U.S. Pat. No. 3,137,276 "Protract-retract mechanism and writing instrument including same" by Weisser, et al, in which a cartridge unit carrying a writing tip is resiliently biased toward the rear of a protecting barrel and a push button is employed so that a first depression of the push button will propel the cartridge unit forwardly whereupon release of the push button will leave the writing tip locked in a protracted position and a second depression and release of the push button will retract the writing tip into a position where the sequence of protraction and retraction can be repeated. Said example includes the provision of simplified push button operated protracting and retracting means in which the push button carries downwardly projecting cam teeth and the cartridge unit and push button are biased by a spring. In U.S. Pat. No. 3,318,289 A, "Bi-stable mechanism" by Marynissen, a similar means is disclosed in which the conversion of an axially applied force into a rotary motion is employed to direct a controlling element into one of two operative positions, a writing element being moved to extended or retracted positions in accordance with which of the operative positions the controlling element assumes.

Alternatively, the biasing mechanism may comprise a user-manipulable pluri-state switch or actuator that is housed separately from, though operatively connected to or in communication with, the load-transfer assembly. Remote actuation of a biasing mechanism, for the purposes of embodiments of the present invention, may be accomplished, for example, by transferring linear force through an ensheathed cable, a flexible rotary shaft, or by wired or wireless electronic means. Herein incorporated to the extent that it is noncontradictory herewith, Watwood et al., in U.S. Pat. No. 6,893,035 B2 "Wheelchair drive mechanism," discloses a remotely-actuatable wheelchair drive system in which a user actuates a shift mechanism to shift a lever-driven wheel between a forward and a reverse drive direction by virtue of a roller mechanism which grabs in one direction and slips an opposite direction. The shift mechanism is disposed remotely from the roller mechanism and is initiated by rotation of a shift paddle; said invention parallels embodiments of the present invention in that it discloses a load-transfer means which may be switched or transitioned between a state that is operable in one direction and a state that is inoperable in the same direction and, furthermore, represents a useful actuation means for an occupant of a wheelchair who has limited range of motion or strength or who is otherwise restricted to manipulating an actuation means from a comfortable, seated position. In a related invention, published in U.S. Pat. No. 8,613,350 B2 entitled "Infinitely Variable Wrench," Nease III discloses an anti-rotation mechanism having a reversible, bearing-type clutch which selectively inhibits rotation in either or both directions of rotation.

In the present invention, the wheel-stand maneuver is utilized as an essential means by which the occupant quickly and conveniently effectuates both the engaging and disengaging actions of the device, and the user is able to complete the full operative sequence while remaining seated in the wheelchair. This stands in contrast to the transitioning means disclosed by Dougherty in U.S. Pat. No. 8,152,192 B2 "All-terrain adapter for a wheelchair," which relies on a broadly-sweeping caster assembly which pivots about an inclined or canted pivot axis to transition between a load-sharing state and a non-load-sharing state. The virtue of having a canted pivot axis in the caster assembly is that it allows the occupant of the wheelchair to vary the vertical position of a forward wheel relative to the wheelchair by simply pivoting the wheel assembly in either a forward or reverse direction and, in effect, raising or lowering the front end of the wheelchair. Unfortunately, said adapter, while its caster wheel is in its non-load-sharing position, spans a very large distance out beyond the foremost portion of the wheelchair, thus presenting space and maneuverability issues. Further, in the aforementioned invention, the adapter is maintained in an operative load-sharing state only during travel in a substantially forward direction, so that sideways or reverse travel lowers the primary caster wheels, thus transitioning the adapter towards an inoperative, non-load-sharing state.

The present invention is furthermore distinct from other wheelchair conversion means. Lasher, in U.S. Pat. No. 8,348,293 B1 "Wheelchair with easily changeable wheel sets," discloses a conversion means which does not facilitate adapting the wheelchair with the user seated in the wheelchair, whether by an assistant or by the occupant himself. In U.S. Pat. No. 8,651,507 B2 "Mounting assembly for attaching auxiliary equipment to a wheelchair" Kylstra et al. discloses a mounting assembly for attaching auxiliary equipment to a wheelchair which includes multiple adjustment features and which utilizes a pair of bilaterally-attaching arms that pivot co-axially with a main column of the auxiliary equipment. Said mounting assembly does not, however, enable robust unilateral attachment to a wheelchair.

Several other notable prior art examples disclose various means of attaching and operating a forward wheel assembly, but do not teach or suggest advantages of a means for attaching and deploying laterally-mounted attachments in a bilaterally-independent fashion. Herve, et al. (FR 2,841,462) discloses a semi-automatic bilaterally-attaching forward wheel assembly which utilizes lateral attachment points on both sides of the wheelchair to support a single forward wheel assembly; the disclosed invention cannot, however, be configured for unilateral attachment. Richter (WO 2010/139507 A1) discloses a centrally-attaching forward wheel assembly that comprises a means for adjusting the tilt angle between a supplemental forward wheel and the wheelchair. Rickard (WO/2011/153,585) discloses a bilaterally-attaching forward wheel assembly which may be transitioned between an operative state and an inoperative state by way of a mechanism extending from the front of the wheelchair seat to a larger diameter wheel, but not in a manner which would accommodate unilateral attachment and operation.

These and other attempts have been made in the prior art to offer wheelchair users a solution to the need for an alternate configuration, particularly for all-terrain use, but there has remained a need for a more interchangeable, adjustable and customizable means of adapting a wheelchair for the wide variety of engagement surfaces encountered by a wheelchair user desiring to venture out and maneuver across, or impart change to, environments in addition to that in and around his or her home.

The option of adapting the same wheelchair in either a unilateral configuration or in a multitude of bilaterally-independent configurations would be appreciated by a person experienced in the art of adaptive wheelchair mobility as being advantageous as a consequence of the versatility afforded to the user. Active wheelchair users, for example may wish to utilize such a means for recreation, exercise, or for enjoyment of scenic or otherwise enjoyable locations outdoors. These locations might include nature trails, playgrounds, grassy fields, snow-covered areas, and muddy or swampy areas.

Other activities may be performed out of necessity, such as negotiating a rough gravel driveway or other path to access a garage, mailbox or wood shed. Further non-recreational everyday activities which may be addressed at least in part by embodiments of the present invention include outdoor chores such as maintaining trees, shrubs, gardens, and other landscaping work, which at the very least require the individual to be able to negotiate terrain that is unlikely as flat and smooth as indoor floor surfaces.

Certain activities may further be facilitated by connecting auxiliary devices to an adaptive implement. For example, it may be beneficial to connect a shield or screen to an all-terrain caster wheel implement in order to ensure objects such as branches, thorns, poisonous plants or tick-infested grasses do not contact the wheelchair user's body, in which case the function of the implement is modified or augmented to improve the wheelchair user's safety and comfort in negotiating challenging surfaces in front of the wheelchair.

Additional activities addressed at least in part by embodiments of the present invention involve direct use of the front and lateral portions of the wheelchair for carrying another person such as a young child or an infant in a compliant carrier, for moving objects such as boxes or crates, or for moving or otherwise imparting change to the ground-engagement surface itself such as sweeping a floor surface, shoveling fallen snow to another area of a driveway or plowing a shallow trench in the soil to prepare a garden for planting.

Indoor activities may also be facilitated by various embodiments of the present invention such as, for example, sweeping or mopping floors, vacuuming carpets, and carrying an IV stand, an oxygen tank, or other medical equipment.

Accordingly, an essential aim of the present invention is to configure a wheelchair for use with an adaptive implement. An adaptive implement is a device or assembly that, upon attachment to a wheelchair and undergoing transition into an operative position by a wheelchair user, occupant or assistant, serves to transform the surface-engagement characteristics of the wheelchair so that it may perform a task or set of tasks that would be difficult, impossible, or inconvenient for a user, occupant or assistant to perform with the wheelchair in its regular, un-adapted state. An adaptive implement may comprise a wheel, a pivotable caster, a motorized wheel, an omnidirectional wheel, a continuous tread, a shovel, a plow, a ski, a skid, a sled, a cart, a carriage, a shield, a brush, a shock-absorbing suspension assembly, a stopping device, a device for ascending or descending steps or curbs, a lawn care device, a wheeled medical device, or a wheeled apparatus for carrying items such as medical equipment, for example. In some cases, the intended purpose of an adaptive implement may be to facilitate maneuverability of the wheelchair and also to facilitate traversal over a ground surface. In other cases, the intended use may be to impart change to the ground surface, such as by shoveling snow, plowing soil, or sweeping dust. Finally, some adaptive implements may be used to add functionality to the wheelchair for carrying a load such as a bag of groceries, a hospital intravenous drip assembly, or even a small child.

It may further be desirable for a wheelchair user to adapt his or her wheelchair to simultaneously perform one or more of the aforementioned activities by utilizing more than one adaptive implement. For example, in the case of shoveling a snow-covered driveway using a shoveling implement, it would perhaps be advantageous for the wheelchair occupant to also utilize one or two ski implements or, instead a single large forward caster wheel implement. Another example would be in the case of a wheelchair user desiring to traverse a nature trail in a densely-wooded forest, where it would be sensible to attach both a large forward caster wheel implement and a shielding implement to prevent unwanted contact with potentially sharp or irritating vegetation.

In attaching a plurality of implements to a wheelchair, the user may desire an arrangement in which a series of implements are attached to a single side. Alternatively, a parallel arrangement may be beneficial or desired so that each opposing side of the wheelchair supports or retains an attached implement that is independently load-bearing from the implement attached to the opposing side. The possibility for a wide range of series and parallel arrangements, as well as combinations thereof, contributes to the versatility afforded to the wheelchair user.

Asymmetric configurations may also be desirable in cases where a single laterally-attached implement is sufficient for performing the task at hand. As an example, it may be suitable to use a single large all-terrain caster implement to place the wheelchair in a three-wheel configuration wherein the primary casters of the wheelchair are elevated and unloaded and the all-terrain caster implement is positioned in front of the wheelchair and in alignment with a vertical longitudinal centerline passing through the wheelchair. Examples are illustrated by Golden, Jr. in U.S. patent application Ser. No. 13/249,278 "Asymmetric Open-Access Wheel Chair" and in U.S. Pat. No. 8,585,071 B2 "Releasable Forward Wheel Apparatus For A Wheelchair," both of which are herein incorporated by reference in their entirety. In such examples, a single caster imparts additional forward stability to the wheelchair, in addition to tripod stability as all three surface-engaging wheels will remain in contact with the ground engagement surface at all times, as opposed to symmetric four-wheel configurations requiring suspension casters to similarly maintain full ground contact. Such an asymmetric configuration has been demonstrated to be desirable because it is lighter in weight and less cumbersome than two all-terrain casters intended for symmetric, bilaterally-independent attachment to the wheelchair.

For the sake of versatility and convenience, it may be preferable in some embodiments of the invention to include a means for switching out or swapping different adaptive implements, all of which may be used in conjunction with at least a portion of the adapter. Wheelchair users, clinicians, caretakers, assistants, and medical staff may realize advantages through availability and use of a variety of different kinds of adaptive implements designed specifically for certain kinds of terrain or for other purposes besides or in addition to traversing various kinds of terrain. Exemplary activities may include: traveling over snow, shoveling or otherwise clearing driveways or sidewalks, plowing soil for home gardening, hauling boxes, materials, or heavy objects, and safely transporting a medical devices in tandem with a wheelchair. Therefore, useful embodiments of the present invention may include an interchanging means for interchangeably attaching adaptive implements to a wheelchair, making said adaptive implements operable, and performing the reverse function—to make said adaptive implements inoperable for subsequent detachment from the wheelchair and further interchange. Providing an interchanging means for connection and simultaneous deployment of compatible implements, whether on the same side of the wheelchair or on opposing sides, enables virtually unlimited combinations of adaptive implements to be used, thereby imparting tremendous versatility to the wheelchair.

It may be desirable to adjust the deployed vertical position of a first adaptive implement relative to the wheelchair such that it is higher or lower than the deployed vertical position of a second adaptive implement relative to the front end of the wheelchair. For example, in the case of a plow-type implement in combination with a large forward caster implement, it would be practical to configure the plow to assume a lower deployed vertical position than that of the caster, in effect providing the wheelchair user greater forward support while the plow digs into the soil surface.

In preferred embodiments, the adaptive implement is secured to the lateral portion of the wheelchair in a releasable fashion, including simple, fast and easy means of attaching and releasing the entire apparatus to and from a lateral portion of the wheelchair. An exemplary releasable attachment means is provided by Lasher in U.S. Pat. No. 8,348,293 B1 "Wheelchair with easily changeable wheel sets," which involves a quick release mechanism in which a large adaptive caster wheel and associated caster fork and bearings all mount to the front of a wheelchair frame and are aligned on the frame with the use of a permanent frame piece used to set the proper height and alignment of the assembly, and is incorporated herein by reference in its entirety to the extent that it is noncontradictory herewith.

Instead of or in addition to the aforementioned means for securing the adapter to the wheelchair, the adapter may include fast and easy means of attaching and releasing an adapting member of the apparatus to and from a mounting member while leaving the mounting member attached to the wheelchair, whether clamped, bolted, welded or otherwise permanently or removeably secured to the wheelchair. Retention of the adapting member to the mounting member may be accomplished by a means such as that disclosed by Mewse in U.S. Pat. No. 3,170,362 A, "Ball detent coupling device with ring shaped friction means" or by a lever-actuated clamp which constricts around an insertable member, such as that disclosed by Golden, Jr. in U.S. Pat. No. 8,585,071 B2, the latter specifically intended for use with wheelchairs and incorporated herein by reference in its entirety to the extent that it is noncontradictory herewith.

A third and especially useful means for releasably attaching an adapting member to a mounting member is an expanding insertion pin, such as that disclosed by Pitzer, et al. in U.S. Pat. No. 3,192,820 A, "Quick release pin," the disclosure of which is incorporated herein by reference to the extent that it is noncontradictory herewith. The expanding quick release pin provides sufficient clearance to be inserted readily into a receptacle or hole and, after insertion therein and actuation of a lever handle, is held tightly within the receptacle by contact between the pin device and the wall of the receptacle. These above objects are achieved, in this case, by providing means for increasing the effective diameter of the pin after installation in the receptacle, so that the pin is held in tight engagement with the wall of the receptacle in operative position, and for reducing the effective diameter of the pin prior to removal, so that the pin regains sufficient clearance to be removed easily from the hole. This change in effective diameter of the pin is accomplished preferably by mounting a radially expansible or adjustable wall thickness bushing about the shank of the pin, and expanding the bushing when the pin is in the hole by means attached to one end of the pin, e.g., a cam means, for applying a compressive force to compress the bushing. Using such compressive force to hold the pin in tight engagement within the receptacle has proven to be a very effective for creating a unified, "play-free" and "wiggle-free" connection between the adapting member and the mounting member, especially for traversing over rough or bumpy surfaces with a wheelchair adapted therewith.

A consequence of the unilateral attachment of an adapter to a wheelchair, as disclosed herein, is that substantially asymmetric loading is placed upon the adapter, and so it is necessary for the adapter to withstand significant torsional strain or other forces tending to deform the structures therein. These forces may be directed thereto during normal, everyday use of the adapter, especially as the user may encounter rough, uneven terrain or simply as a result of the occupant shifting his or her weight in the seat of the wheelchair. Therefore, in preferred embodiments of the invention, whether an adaptive implement is secured to the lateral portion of the wheelchair in a releasable fashion or, rather, in a non-removable yet transitionable manner, the union of the adapter and the wheelchair must be sufficiently rigid so that the performance, safety, and longevity of all parts of the adapted wheelchair are substantially unaffected by torsional strain and asymmetric loading placed upon the adapter as a result of a load borne completely or in part by the adapter. Furthermore, movement of a moveable portion of the adapter must be restricted so that the events undertaken by a transitioning mechanism are substantially isolated from, and thus uninfluenced by, torsional strain and asymmetric loading placed upon the adapter as a result of a load borne completely or in part by the adapter.

In embodiments of the present invention a first adaptive implement, connected to a lateral portion on a first side of the wheelchair, is both structurally and operatively independent of a second adaptive implement connected to a lateral portion of a second, opposing side of the wheelchair. As a result, embodiments of the present invention must withstand significant torque in all clamping members and support members as well as all moving and bearing members due to the asymmetric or unbalanced loading that occurs by virtue of the lateral placement all or portions of the apparatus. To these ends, embodiments may comprise a bolt, a clamp, an insertable pin, a receptacle, a quick-release pin, an expansion pin, or the like, for the purpose of facilitating strong, secure, and accurately aligned attachment. The challenges and solutions involved in achieving a reliable connection to lateral portions of a wheelchair frame, especially in a releasably secure fashion, have been addressed by Golden, Jr. in U.S. patent application Ser. No. 13/249,278 "Asymmetric Open-Access Wheel Chair" and in U.S. Pat. No. 8,585,071 B2 "Releasable Forward Wheel Apparatus For A Wheelchair." Embodiments of the foregoing disclosures, however, are not inclusive of a transitioning mechanism which employs an operative sequence such as that delineated in the present disclosure.

Another general aim of the present invention is to enable rapid and reliable attachment and detachment of an adaptive implement, relative to the primary frame of the wheelchair, in order to convert the wheelchair between an original mode and an adapted mode. Crucial to this aim is the challenge of permitting movement of various components relative to one another to enable a user or occupant to transition the device through an operative sequence, while also ensuring strong, secure and play-free attachment of the adaptive implement to the wheelchair while in an operative state. Additionally, the present invention aims to ensure that, while detached, the adaptive implement remains correctly adjusted or configured so that it may be reliably attached to the wheelchair and engaged for optimal performance. In meeting these challenges together, embodiments of the present invention enable repeatable conversion of the wheelchair between the original mode and the adapted mode.

A particular aim of various embodiments of the present invention is to enable an occupant of the wheelchair to willfully transition the wheelchair between an inoperative state, in which an adaptive implement is nonfunctional and non-load-sharing, and an operative state, in which the adaptive implement is functional and load-sharing. During the inoperative state, the adaptive implement bears a minimum amount of the weight resulting from the force of gravity on a load that is attached to or supported directly by the adaptive implement or that is attached to or supported by the wheelchair. During the operative state, the adaptive implement must be capable of bearing a maximum amount of the weight resulting from the force of gravity on the load attached to or supported by the adaptive implement or the wheelchair.

Another particular aim of various embodiments is to ensure that, upon a user or an occupant of the wheelchair transitioning the adaptive implement into the operative state, the adaptive implement is maintained in the operative state during travel of the wheelchair in all directions.

A further particular aim of various embodiments is to ensure that, while the adaptive implement is in the operative state, the adaptive implement moves in concert with movements of the wheelchair.

A further particular aim of preferred embodiments is to enable an occupant of the wheelchair to transition the wheelchair between an original mode and an adapted mode by exploiting the "wheelie" or wheel-stand maneuver, which is well-known to those experienced in the art of manual wheelchair mobility. To a similar end, preferred embodiments may usefully enable an assistant to transition the wheelchair between the original mode and the adapted mode by reclining the wheelchair, such as from behind the user while grasping handles affixed to the backrest of the wheelchair.

Thus, in preferred embodiments, a wheelchair occupant or an assistant thereof is afforded the ability to: 1.) connect the adaptive implement to the lateral portion of the wheelchair, 2.) willfully transition the apparatus in order to place the adaptive implement in an operative state, 3.) utilize the attached adaptive implement for its intended purpose, 4.) willfully transition the apparatus in order to place the adaptive implement in an inoperative state, and 5.) release the adaptive implement from the lateral portion of the wheelchair.

Also, in preferred embodiments, the attachment means is constructed so that it is lightweight, compact, durable, and aesthetically appealing.

BRIEF DESCRIPTION OF THE DRAWINGS

The above-mentioned features of the invention will become more clearly understood from the following detailed description of the invention read together with the drawings in which.

DETAILED DESCRIPTION OF THE DRAWINGS

An apparatus for unilateral attachment of an adaptive implement to a wheelchair 100 and for transitioning the same between a load-sharing state and a non-load-sharing state is disclosed.

Figure 1A:
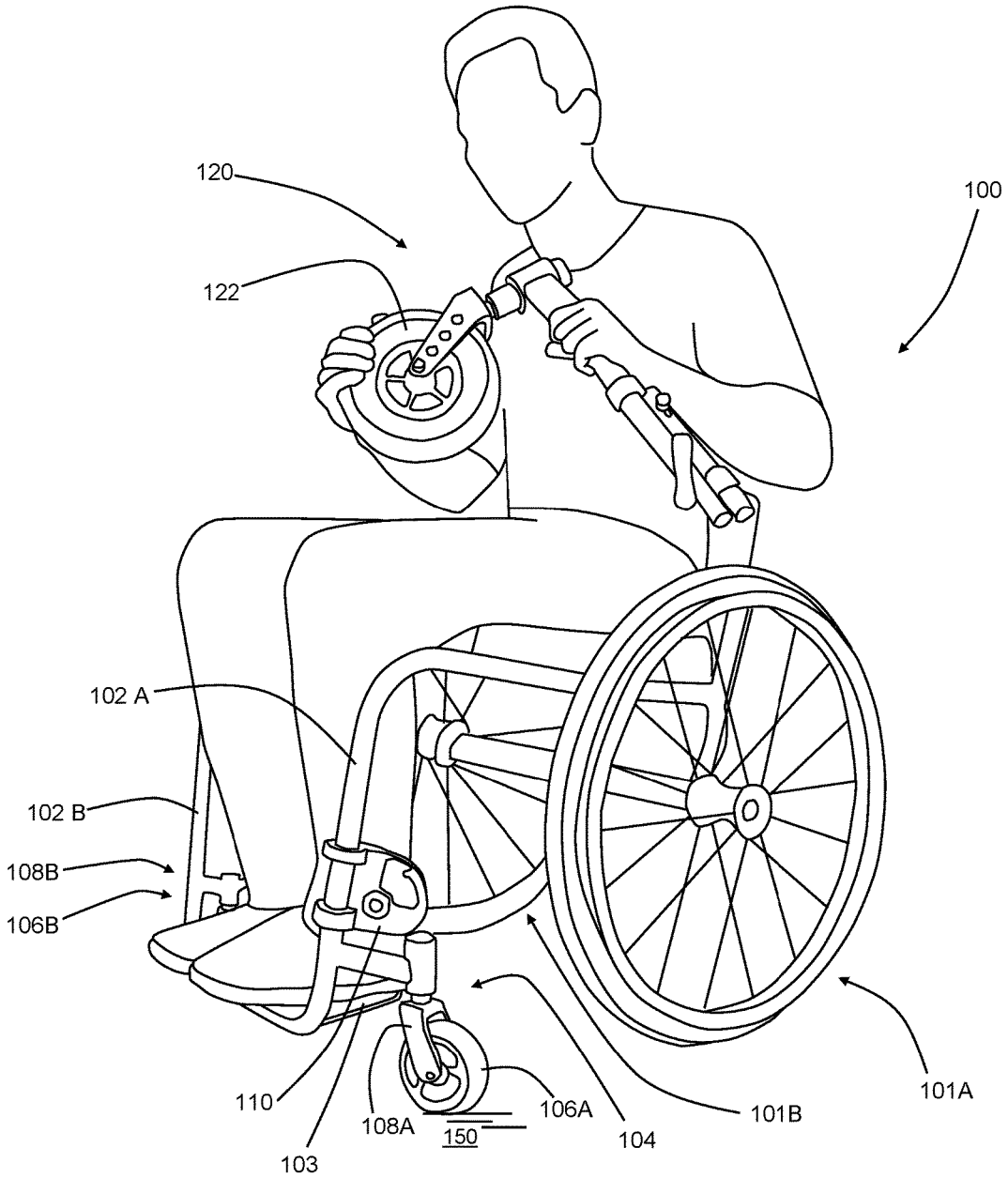
FIG. 1A shows a wheelchair occupant holding an adapting member equipped with a large caster wheel implement while seated in a wheelchair outfitted with a mounting member.

FIG. 1A depicts a wheelchair occupant seated in his wheelchair 100 and holding an adapting member 120 equipped with a large caster wheel 122 having a diameter of 8 inches. The wheelchair comprises opposing drive wheels, 101A and 101B, footrest 103, primary caster assemblies 108A (visible) and 108B (not shown) comprising caster wheels 106A (visible) and 106B (not shown), respectively. Attached to forward lateral frame element 102A of wheelchair 100 is a mounting member 110. Opposing forward lateral frame element 102B does not have an attached mounting member, although it would suitably accommodate a mounting member of mirror-image construction in comparison to that of mounting member 110. The mounting member 110 is attached to forward lateral frame element 102A such that it occupies a space immediately above caster cylinder 104 which houses bearings and fastening elements to enable primary caster assembly 108A to pivot freely in all directions while also remaining securely affixed to the wheelchair in a load-sharing fashion. The footrest 103, in this illustration, is in its lowest possible position relative to the ground surface 150 and the caster wheels 106A (visible) and 106B (not shown) are in direct contact with the ground surface 150.

Figure 1B:
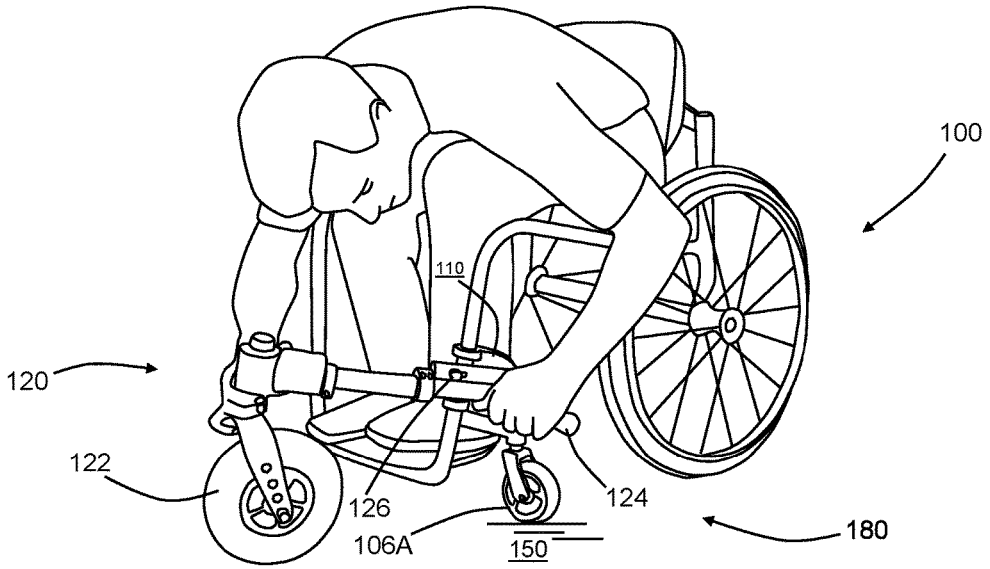
FIG. 1B shows the wheelchair occupant leaning forward and connecting the adapting member to the mounting member.

FIG. 1B depicts the seated wheelchair occupant leaning forward and placing the adapting member 120 in a coupled position relative to the mounting member 110. With his left hand, the user is also pulling inwardly on expansion pin assembly lever handle 124 to secure the inserted position of an expanding insertion pin (not shown) relative to the mounting member 110; the coupling or union established therein prevents relative lateral movement between the adapting member 120 and the mounting member 110, yet permits relative rotational movement therebetween. Input knob 126 is seen in its forwardmost position.

Figure 1C:
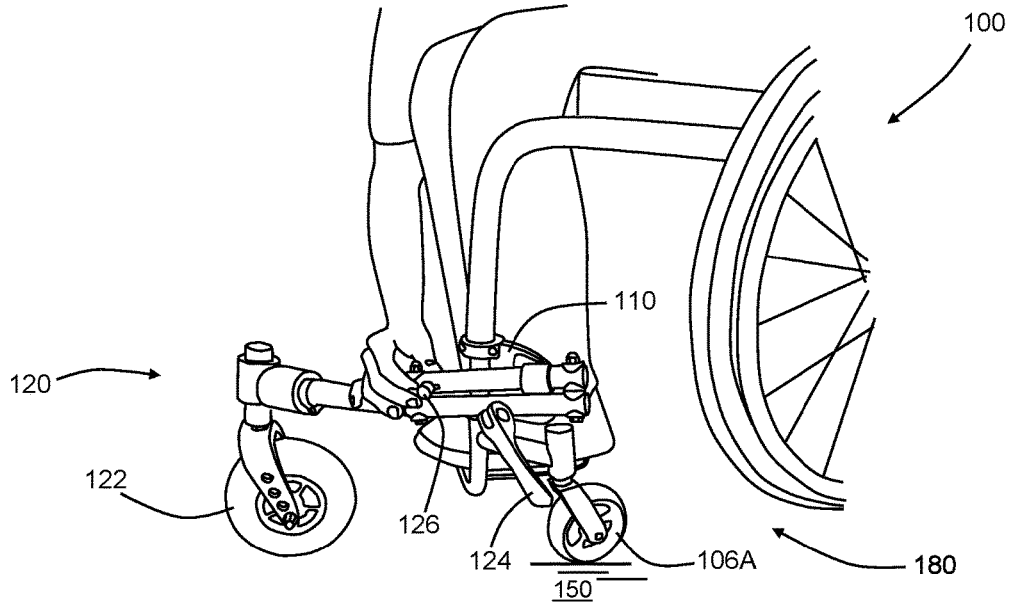
FIG. 1C shows the wheelchair occupant manipulating a sliding knob on the adapting member to put the adapter into a pre-operative internal stage.

In FIG. 1C, the user is pushing with his right hand, in the rearward direction, against the input knob 126 to switch the adapting member to an internal pre-operative stage, after which action the input knob 126 will return to its forwardmost position.

Figure 1D:
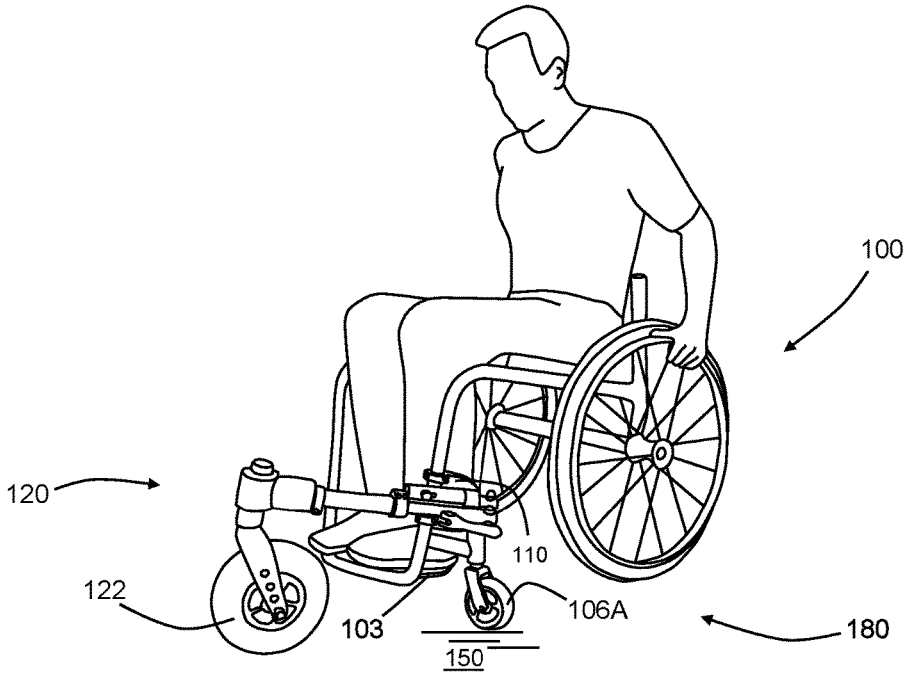
FIG. 1D shows the wheelchair occupant sitting upright and beginning to perform a wheel-stand maneuver to effectuate the transition of the adapter to the operative state.

FIG. 1D shows the user sitting upright, preparing to perform a wheel-stand maneuver. At this moment, the large caster wheel 122, primary caster wheels 106A (visible) and 106B (not shown), and rear drive wheels 101A and 101B are all in contact with the ground surface 150. Also, at this time, the primary caster wheels 106A and 106B are bearing a portion of the load carried by the wheelchair, which includes both the weight of the occupant and the wheelchair itself. The adapting member 120 and the large caster wheel 122 are non-load-bearing and are upwardly and downwardly rotatable about the axis of the expanding insertion pin (not shown).

Figure 1E:
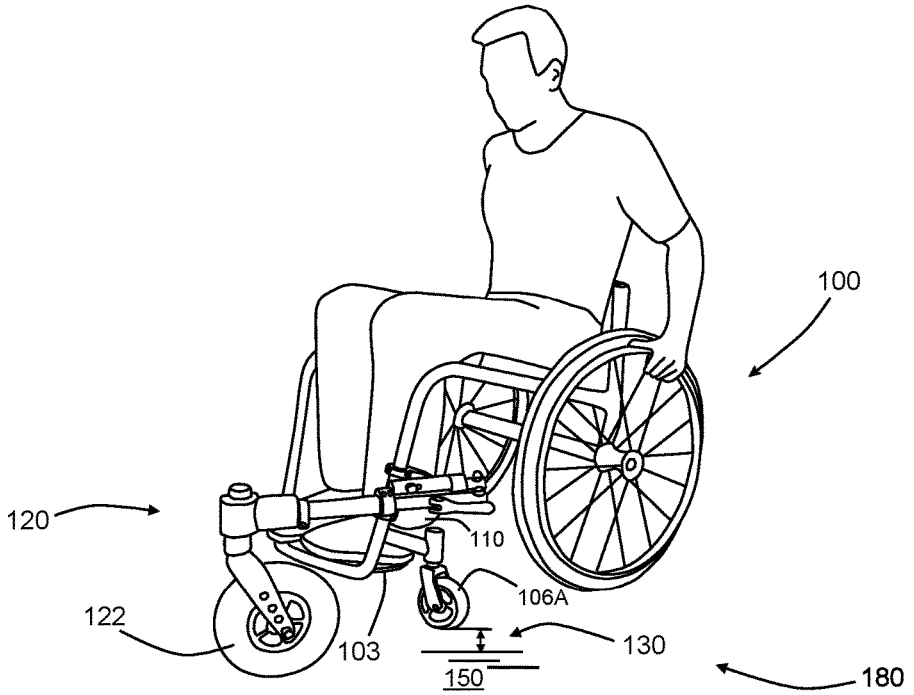
FIG. 1E shows the wheelchair occupant sitting upright with the wheelchair in the operative state after having performed the wheel-stand maneuver.

Illustrated in FIG. 1E, as the user controllably leans his torso backwards while pushing forwardly against the upper regions of rear drive wheels 101A and 101B, the large caster wheel 122 remains in contact with the ground surface 150 and the primary caster wheels 106A and 106B become elevated from the ground surface 150 so that they no longer bear any portion of the load that is carried by the wheelchair.

The primary caster wheels 106A (visible) and 106B (not shown) as well as the footrest 103 are all transitioned to an increased vertical position relative to the ground surface 150, thereafter leaving substantially more clearance beneath these forward structures of the wheelchair 100. As a result of this increased clearance, obstacles laying on or contained within the ground surface 150 may be more readily traversed over by the user, who also experiences decreased rolling resistance and increased forward stability with now having the separable-type adapter 180 in its operative state.

Removing the adapting member 120 and caster wheel 122 from the wheelchair 100 is accomplished by carrying out the sequence depicted in FIGS. 1A through 1E in reverse order, which ultimately results in transitioning the separable-type adapter 180 from the operative state to the inoperative state and subsequently decoupling the adapting member 120 from the mounting member 110.

Figure 2:
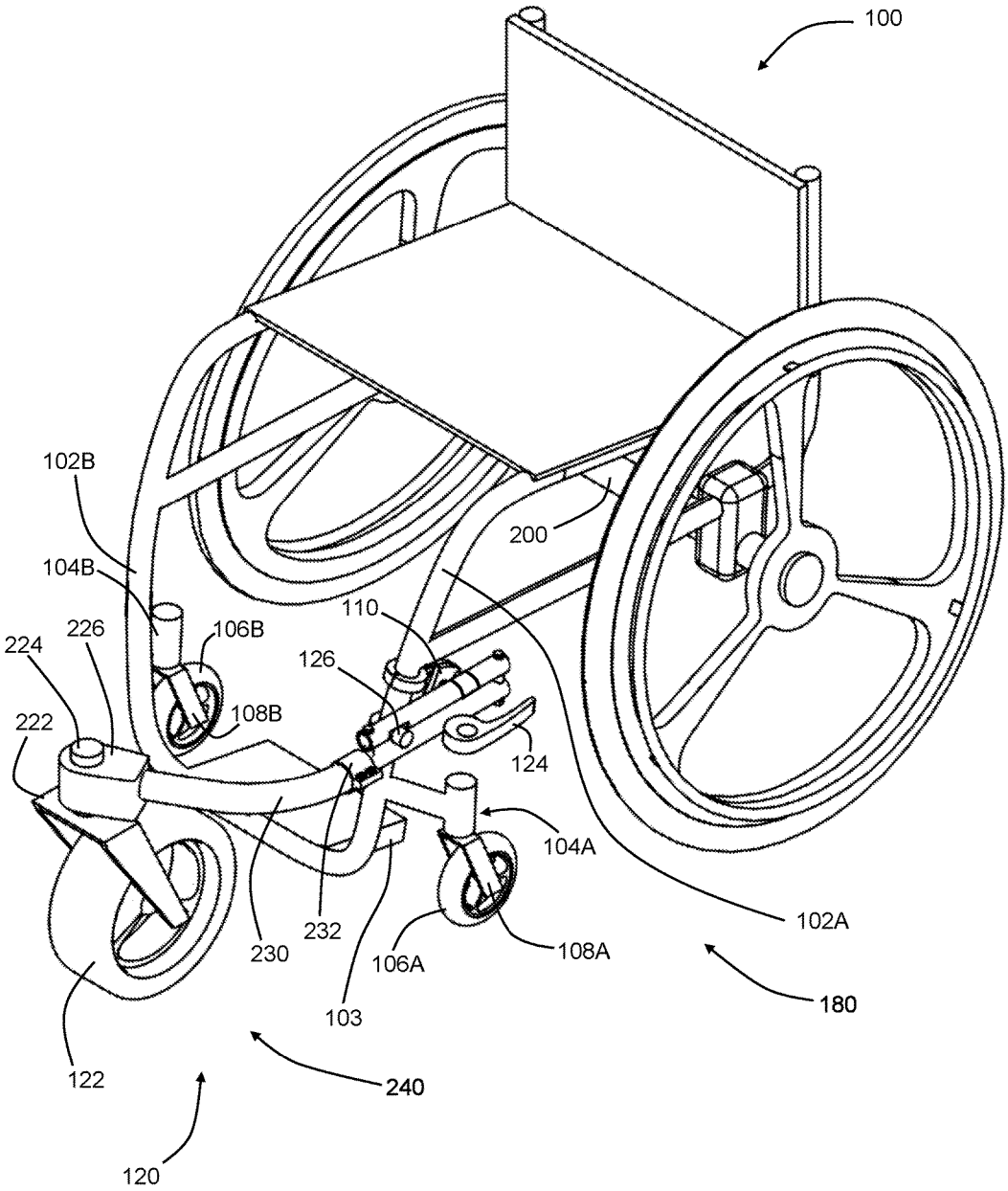
FIG. 2 is a perspective view of an unoccupied wheelchair outfitted with a separable-type adapter having a mounting member and an adapting member, the adapting member equipped with a caster wheel implement.

FIG. 2 displays a similarly-configured wheelchair 100 left unoccupied and with an attached adapting member 120 equipped with a large caster wheel 122. The separable-type adapter 180, in this depiction, is in its operative state. A curved tubular support member 230 interconnects the pivotable caster assembly 240 to the adapting member 120. The curved tubular support member 230, which disposes the pivotable caster assembly 240 at a central forward location relative to the wheelchair 100, may also serve as a caster positioning means. By loosening tube clamp 232 and caster mounting block 226 in relation to the curved tubular support member 230, rotation of the curved tubular support member 230 may be performed in either direction and may be used to alter both the pitch orientation and the roll orientation of the pivot axis of the pivotable caster assembly 240. This method, used in conjunction with rotational adjustment of the mounting member 110 about the lateral frame element 102A of the wheelchair 100 and vertical adjustment of the caster cylinder 224 relative to the caster mounting block 226, permits a high degree of adjustability of the adaptive implement (the pivotable caster assembly 240) relative to the wheelchair 100. It is to be understood that many other details for attachment, adjustment, release, and other operations of the adapter may be made without departing from the scope of the invention as claimed, and that additional attachment assemblies may be present, as desired, also without departing from the scope of the invention as claimed.

Figure 3A:
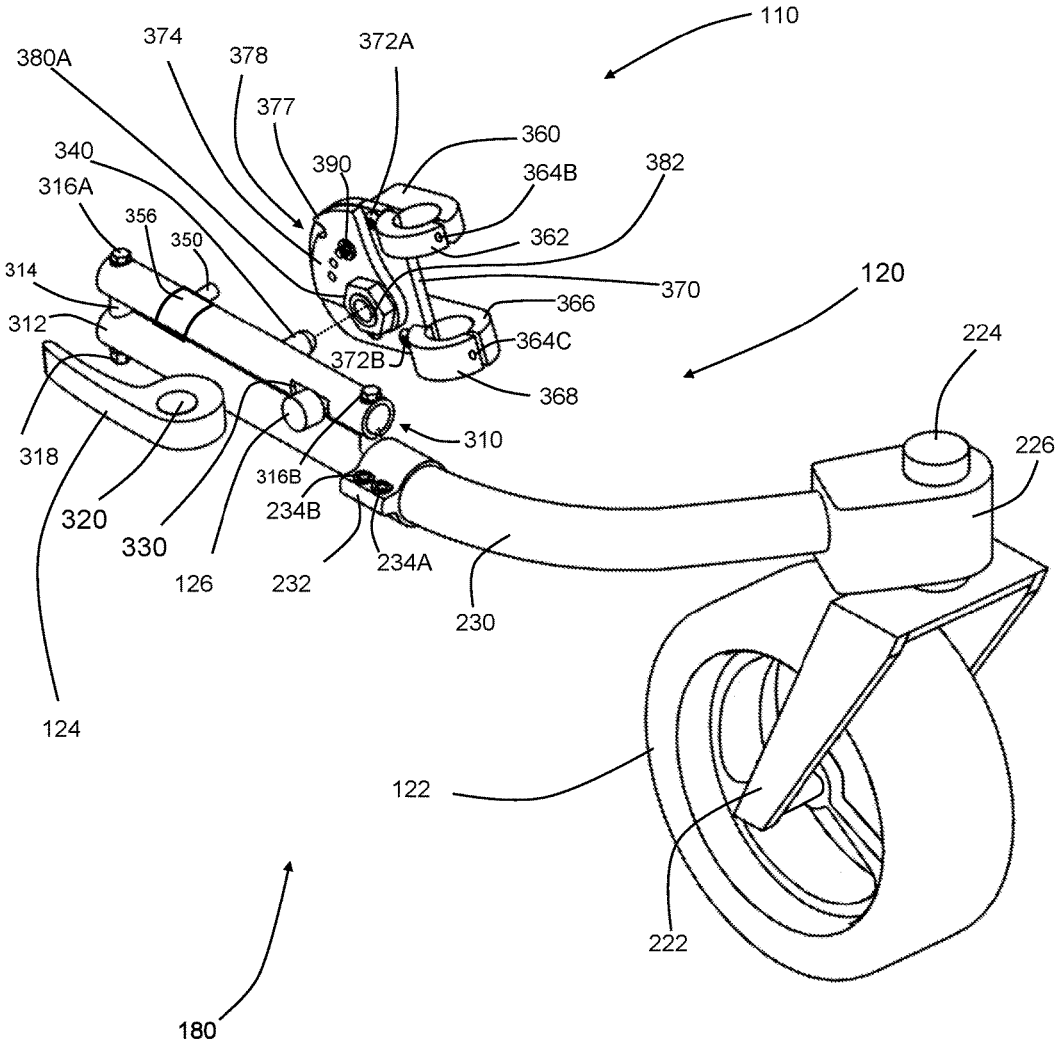
FIG. 3A displays the coupling relationship of the mounting member with the adapting member, both detached from the wheelchair.
Figure 3B:
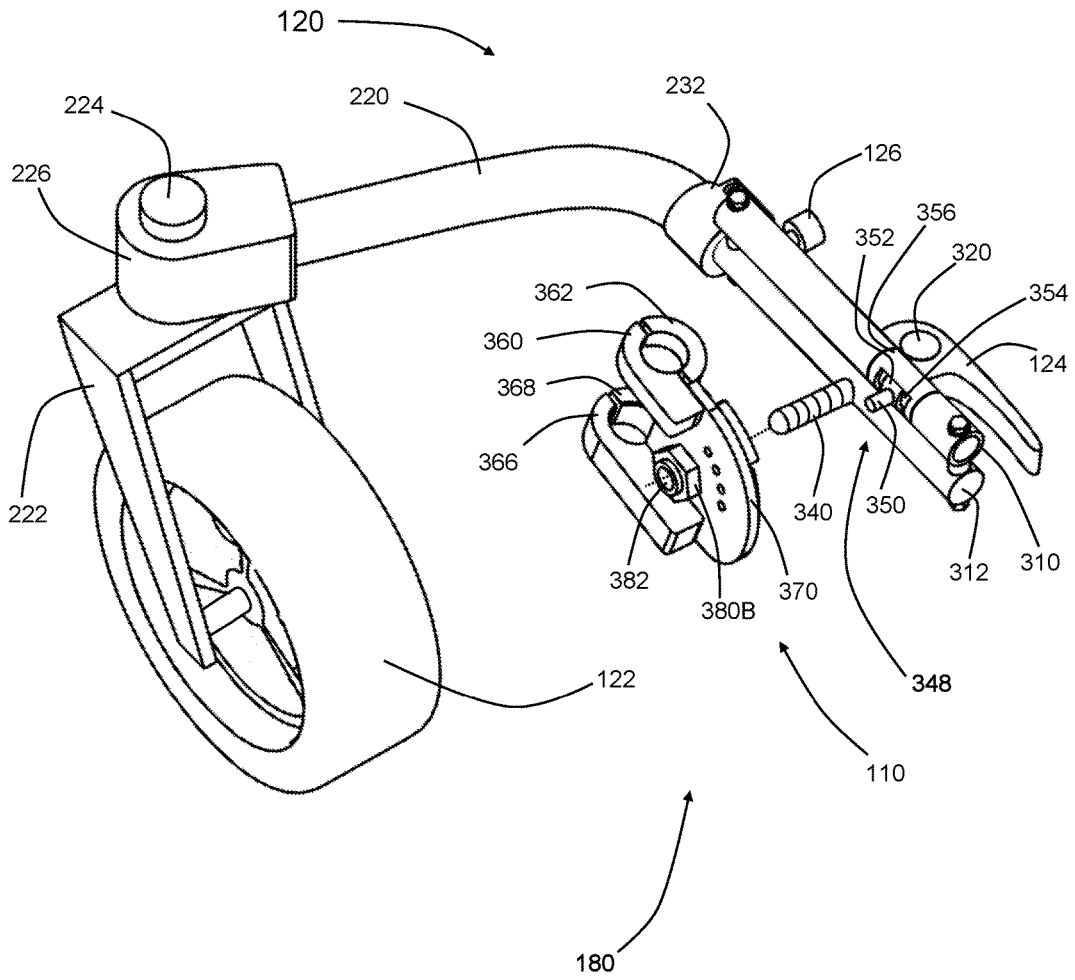
FIG. 3B displays an alternate view of the coupling relationship of the mounting member with the adapting member, both detached from the wheelchair.

FIG. 3A displays a partially-exploded view of the adapting member 120 and the mounting member 110, indicating the manner and direction in which the expanding insertion pin 340 inserts into tubular receptacle 382 of the mounting member 110. Other elements of the adapting member 120 and the mounting member 110, which were implied though not described in previous figures, are visible in FIGS. 3A, 3B and 3C. The mounting member 110 comprises an upper fastening body 360, an upper arcuate fastening element 362, a lower fastening body 366, a lower arcuate fastening element 368, fastening bolts 364A, 364B, 364C, and 364D, a rigid structural plate 370, structural plate bolts 372A 372B and 372C, and a bearing plate 374. A tubular receptacle 382 projects through an aperture in bearing plate 374 and also through an aperture in rigid structural plate 370, and is fastened on both sides by receptacle nuts 380A and 380B.

The adapting member 120 comprises a load-transfer assembly 310, a solid body 312, and connector bolts 316A and 316B to connect the load-transfer assembly 310 to the solid body 312. To aid in rigidizing and ensuring the integrity of the bolted connection between the load-transfer assembly 310 and the solid body 312, a pair of saddle washers 314 are placed therebetween. Projecting through an aperture in the solid body 312 is an expanding insertion pin 340 operatively connected to a cam assembly 320, which is actuated by user manipulation of the lever handle 124. Upon inserting the expanding insertion pin 340 into the tubular receptacle 382 of the mounting member 110 and subsequently pulling back on the lever handle, the expanding insertion pin 340 establishes and maintains a secure grip within the tubular receptacle 382 to effectively secure the adapting member 120 to the mounting member 110. By virtue of the strong union created between the adapting member 120 and the mounting member 110, the adapted wheelchair is capable of withstanding the torsional strain and asymmetric loading placed thereupon during normal use, and rotation of the adapting member 120 about the axis of the expanding insertion pin 340 is sufficiently isolated to ensure that the separable-type adapter 180 may be transitioned without being hindered by any torsional strain and asymmetric loading placed upon the separable-type adapter 180 as a result of a load borne completely or in part by the separable-type adapter 180.

Adjustments made at the union between the expanding insertion pin 340 and the cam assembly 320, such as by turning the lever handle 124 around a threaded end (not shown) of the expanding insertion pin 340, amplifies the pressure established between the expanding insertion pin 340 and the inner surface of the tubular receptacle 382 to further unify the adapting member 120 with the mounting member 110. As a result, during transition and while in the operative state, most if not all "wiggle," vibration and "play" between the adapting member 120 and the mounting member 110 is eliminated during normal use of the adapted wheelchair. While traversing over ground surfaces, the occupant of the wheelchair 100 experiences a very solid and secure ride due to the tightly unified separable-type adapter 180 and wheelchair 100.

The adapting member 110 additionally comprises a moveable bearing assembly 348 which comprises a cylindrical bearing element 350 connected to an arcuate bearing element 352. Upon the user manipulating the input knob 126 by pushing it in the rearward direction, the cylindrical bearing element 350 and the arcuate bearing element 352 move, linearly, in the forward direction or in the rearward direction, depending on the current internal stage of the load-transfer assembly 310. The forwardmost and rearwardmost positions occupied by the arcuate bearing element 352 are limited by the length of the bearing opening 330 of bearing sleeve 356 which surrounds the load-transfer assembly 310 and which is bolted or welded to the solid body 312 to prevent linear movement or rotation of the bearing sleeve 356. Repeated manipulation of the input knob 126 alternates the position of the moveable bearing assembly 348 between a forward position and a rearward position within the bearing opening 330.

Projecting through the bearing plate 374 and into the rigid structural plate 370 is an adjustment bolt 390. Upon removal of the adjustment bolt 390, the bearing plate 374 may be rotated about the axis 384 of the tubular receptacle 382 relative to the rigid structural plate 370, after which the adjustment bolt 390 may be reinserted and tightened into one of the three other adjustment holes 390 to alter the effective angle created between an attached adaptive implement (in this case, the caster wheel) and the wheelchair 100 upon deploying the separable-type adapter 180 into the operative state.

It is important to note that the aforementioned arrangement of the moveable bearing assembly 348, the bearing sleeve 356, the load transfer assembly 310, the solid body 312, the expanding insertion pin 340, the mounting member 110, and all fastening and clamping means associated therewith, allows for sufficient movement of the cylindrical bearing element 350 so that it may readily engage with and disengage from the nested groove 378, and wherein the adapting member 120 of the separable-type adapter 180 is releasably securable to the mounting member 110 such that the separable-type adapter 180 maintains a position and orientation relative to the wheelchair while in the load-sharing state, preferably through many cycles of attaching, operating, and releasing the adapting member 120 relative to the mounting member 110. In the process, all torsional strain and loading experienced by the adaptive implement attached thereto is borne by the foregoing elements, especially due to the asymmetric loading experienced as a result of the independent lateral attachment to the wheelchair 100. The success with which the design, construction, and choice of materials hold up to this anticipated asymmetric strain will impact the performance, safety, and longevity of the apparatus as well as the proper functioning of the mechanism employed to carry out the transitioning thereof through all stages of the operative sequence.

Figure 3C:
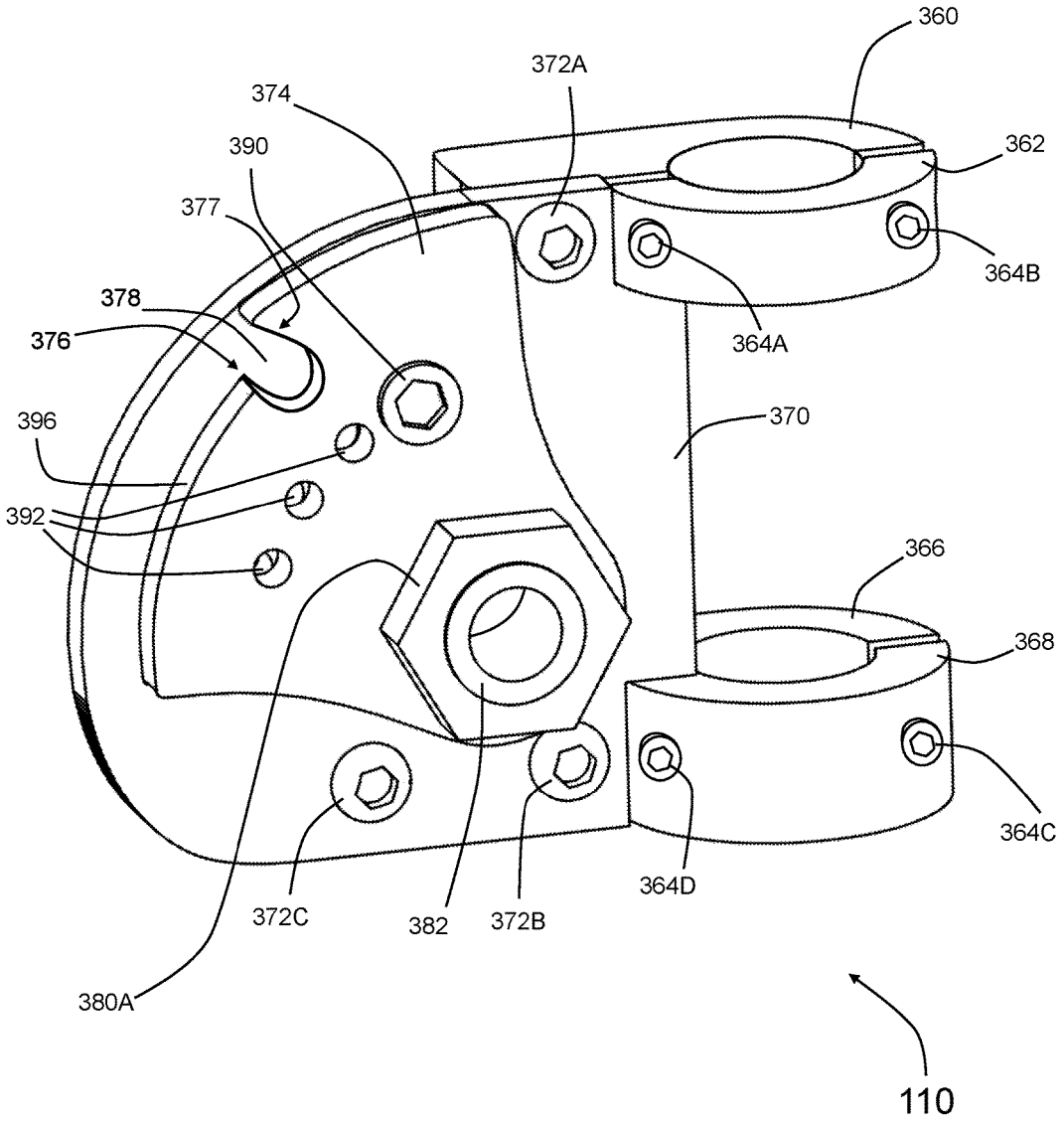
FIG. 3C displays the mounting member of the separable-type adapter.

FIG. 3C shows the mounting member 110 having a bearing plate 374 comprising a nested groove 378 and a bearing stop 377 against which the cylindrical bearing element 350 (not shown) momentarily contacts during transitioning of the adaptive implement into the operative state. Loading during the operative stage is substantially focused on the lower bearing surface 376 of the nested groove 378.

During the inoperative state, as well as during transition into and out of the inoperative state, the cylindrical bearing element 350 slides in an arcuate path in contact with or in close proximity to the arcuate bearing surface 396 of the bearing plate 374. The axis 384 of the expanding pin 340 serves as a fulcrum around which the adapting member 120 rotates; the shape of the arcuate bearing surface 396 may thus be defined as an arc having a radius equal to the distance from the axis 384 of the expanding insertion pin 340 to the nearest contact point of the cylindrical bearing element 350 while the load-transfer assembly 310 is in the internal inoperative stage or during transition into or out of the internal inoperative stage. Furthermore, to ensure maximum contact of the cylindrical bearing element 350 with the contact surfaces of the nested groove 378, the deepest point of the nested groove may be defined by the distance from the axis 384 of the expanding insertion pin 340 to the nearest contact point of the cylindrical bearing element 350 while the load-transfer assembly 310 is in the internal operative stage.

During the internal operative stage, as well as during the internal pre-inoperative stage, the cylindrical bearing element 350 is disposed in the nested groove 378 of the bearing plate 374. Upwardly directed force (due to downward loading on the front end of the wheelchair) is leveraged about the axis 384 of the expanding pin 340 and transferred downwardly against the lower bearing surface 376 of the nested groove 378. Supporting of a load by the separable-type adapter 180 relies on the integrity of the elements of the moveable bearing assembly 348 as they transfer the load from the adapting member 120, through the cylindrical bearing element 350 and the arcuate bearing element 352, to the bearing sleeve 356, and finally to the bearing plate 374.

FIGS. 4A through 4D illustrate the positioning of the internal components of the load-transfer assembly 310 and the positioning of the entire adapting member 120 relative to the mounting member 110 during the four internal stages of the operative sequence, the transition through which is effectuated by the user manipulating the input knob 126 and subsequently performing a wheel-stand maneuver or otherwise controllably reclining the wheelchair 100. In this way, the load-transfer assembly 310 transitions in a cyclical fashion from an internal inoperative stage, to an internal pre-operative stage, to an internal operative stage, to an internal pre-inoperative stage, and back to the internal inoperative stage.

The input knob 126, which is intended to be pushed by the user in the rearward direction, is affixed to an input slider 414 which fits snugly and is able to slide smoothly inside the tubular casing 450 of the load-transfer assembly. The input slider 414 is further connected to an input post 412 of a bistable switching mechanism 410 which is prevented from moving within the tubular casing 450 by a set screw 460 penetrating through the tubular casing 450 and pressing against the outer surface of the bistable switching mechanism 410. Linear movement of the input slider 414 produces linear movement of the input post 412 to effectuate a state change in the bistable switching mechanism 410; the bistable switching mechanism 410 toggles between a first state and a second state, which in turn alternates an output rod 408 of the bistable switching mechanism 410 between a protracted position and a retracted position. Connected to the end of the output rod 408 is an output slider 406 which fits snugly and slides smoothly inside the tubular casing 450 and which, likewise, is alternated between a protracted position and a retracted position.

Figure 4A:
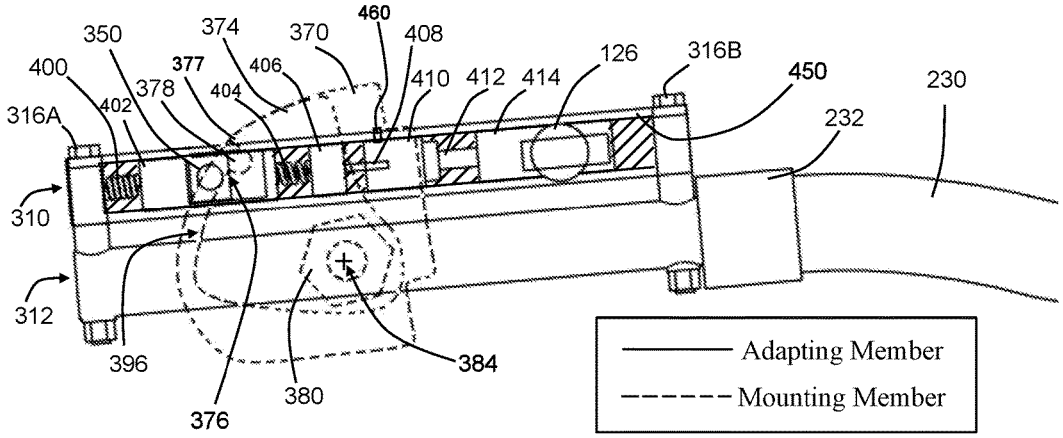
FIG. 4A is a sectional view illustrating the positioning of the internal components of the load-transfer assembly and the positioning of the adapting member relative to the mounting member during the internal inoperative stage.

In FIG. 4A, starting with the load-transfer assembly 310 in the internal inoperative stage, that is—with the adapting member 120 attached to the mounting member 110, while non-load-sharing, and prior to the user pushing the input knob 126 in the rearward direction, the output slider 406 is in its most protracted position and, as a result, applies maximum force against a disengagement spring 404, which in turn applies spring pressure against the sliding body 402 of the moveable bearing assembly 348. As the adapting member is rotated about the axis 384 of the expanding insertion pin 340, such as if the user performs a wheel-stand maneuver, the cylindrical bearing element 350, connected to the sliding body 402, remains out of contact, due to the spring pressure from the disengagement spring 404, from the nested groove 378 of the bearing plate 374. For this reason, attaching and releasing of the adapting member 120 to and from the mounting member 110 is made possible during the internal inoperative stage.

Figure 4B:
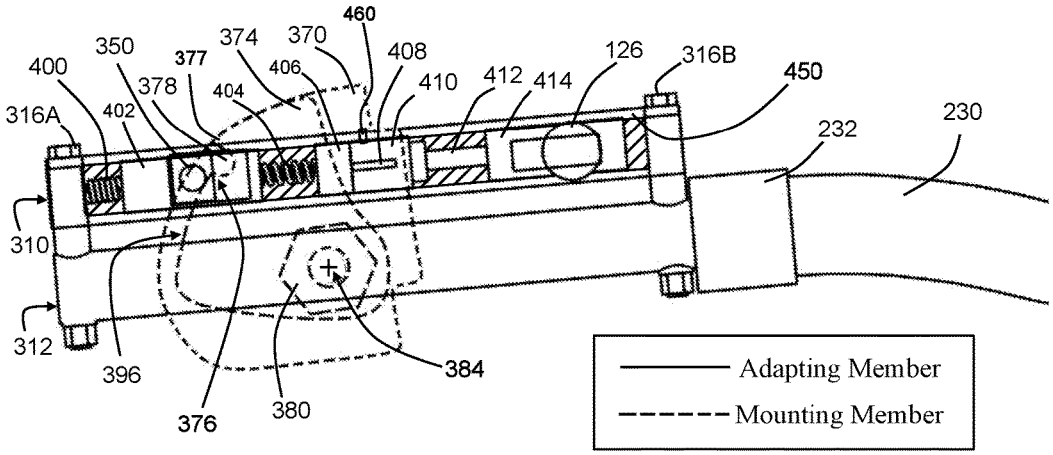
FIG. 4B is a sectional view illustrating the positioning of the internal components of the load-transfer assembly and the positioning of the adapting member relative to the mounting member during the internal pre-operative stage.

Upon the user pressing rearwardly against the input knob 126, the bistable switching mechanism 410 is toggled from the first state to the second state, ultimately resulting in movement of the output slider 406 from the protracted position to its most retracted position and relaxation of compressive force against the disengagement spring 404, thereby placing the load-transfer assembly 310 into the internal pre-operative stage, shown in FIG. 4B, in which it will remain until the user performs a wheel-stand maneuver to move the cylindrical bearing element 350 in an arcuate path along the arcuate bearing surface 396 of the bearing plate 374 toward the nested groove 378.

Upon the user performing the wheel-stand maneuver, thereby effectuating a change in the angular position of the adapting member 120 relative to the mounting member 110, the cylindrical bearing element 350 moves into full contact, within the nested groove 378, with the bearing plate 374. After the user has completed the wheel-stand maneuver and brings the front end of the wheelchair down so that the large caster wheel (not shown) contacts the ground surface, upwardly directed force (due to downward loading on the front end of the wheelchair) is leveraged about the axis 384 of the expanding insertion pin (not shown) and transferred downwardly against the lower bearing surface 376 of the nested groove 378. Movement of the cylindrical bearing element 350 into the nested groove is further promoted by an engagement spring 400, which applies force in the forward direction against the sliding body 402 of the moveable bearing assembly 348. In this way, upon transitioning the load-transfer assembly into the internal operative stage, it will remain in the internal operative stage until the force of the engagement spring 400 is overcome as a result of toggling the bistable switching mechanism 410 from the second state to the first state and subsequently performing a wheel-stand maneuver.

Figure 4C:
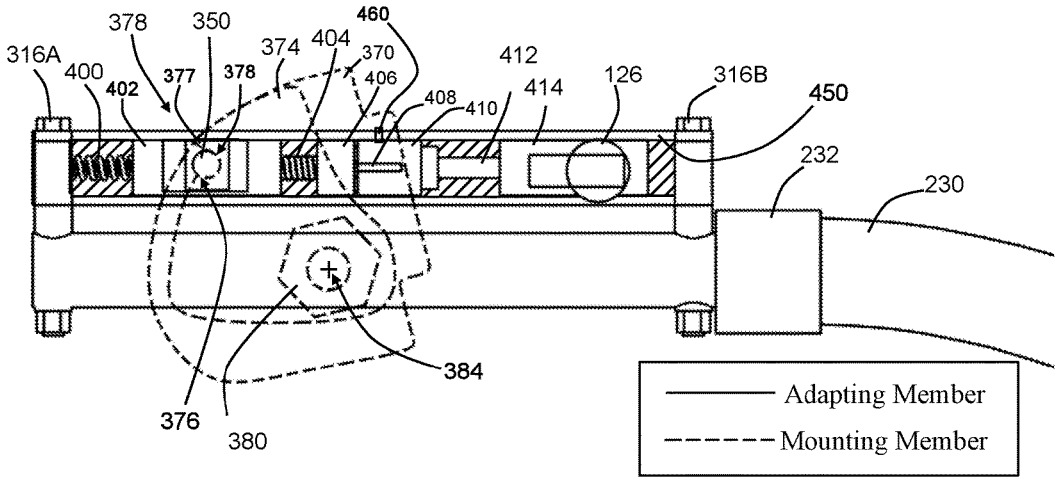
FIG. 4C is a sectional view illustrating the positioning of the internal components of the load-transfer assembly and the positioning of the adapting member relative to the mounting member during the internal operative stage.
Figure 4D:
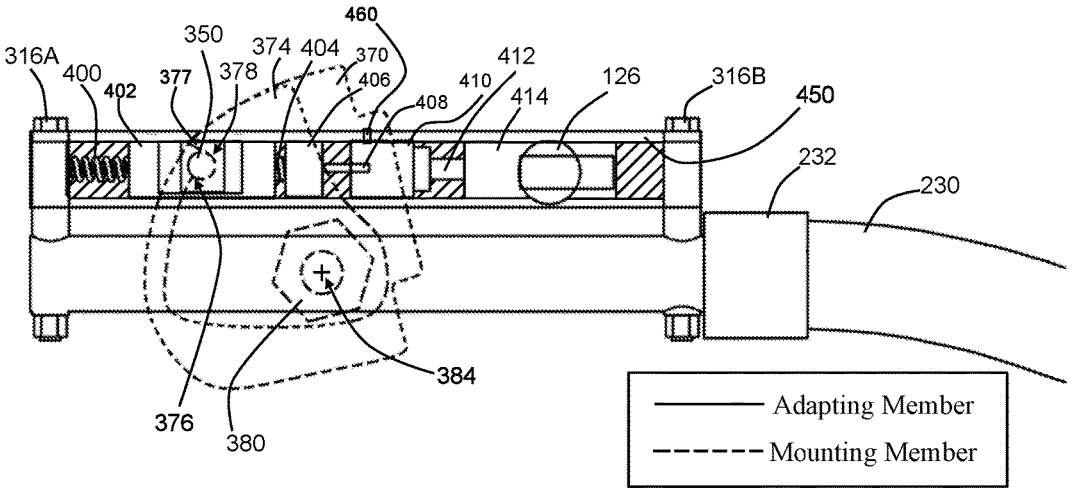
FIG. 4D is a sectional view illustrating the positioning of the internal components of the load-transfer assembly and the positioning of the adapting member relative to the mounting member during the internal pre-inoperative stage.

As can be seen in FIGS. 4C and 4D, while the load-transfer assembly 310 is in the internal operative stage, upon toggling the bistable switching mechanism 410 from the second state to the first state, linear urging force is output through the output rod 408 to the output slider 406; this applies rearwardly directed force against the disengagement spring 404, the opposite end of which is in contact with the sliding body 402 of the moveable bearing assembly 348. Compression of the disengagement spring 404, in turn, urges the sliding body 402 in the direction away from the bistable switching mechanism 410. Friction between the contact surfaces of the cylindrical bearing element 350 and the nested groove 378 of the bearing plate 374, as a result of load-bearing by the apparatus, maintains the cylindrical bearing element 350 in contact with the nested groove 378. In this manner, the load-transfer assembly 310 is thus transitioned from the internal operative stage into the internal pre-inoperative stage, and remains so until the user performs a wheel-stand maneuver.

While the load-transfer assembly 310 is in the internal pre-inoperative stage, as in FIG. 4D, subsequent performance of a wheel-stand maneuver by the user substantially reduces any friction maintained between the contact surfaces of the cylindrical bearing element 350 and the nested groove 378 of the bearing plate 374 so as to permit movement of the entire moveable bearing assembly 348, thus disengaging the cylindrical bearing element 350 out of contact within the nested groove 378 and compressing the engagement spring 400. This transitions the load-transfer assembly into the internal inoperative stage; as in FIG. 4A, the output slider 406 is again held by the bistable switching mechanism 410 in its most protracted position and, as a result, applies maximum force against the disengagement spring 404.

Figure 5:
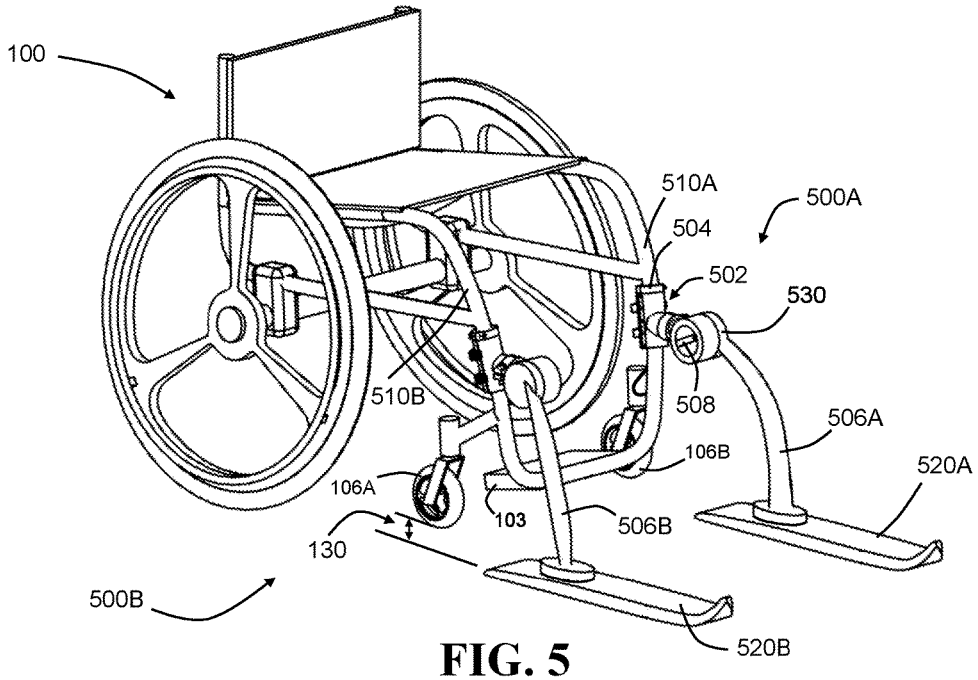
FIG. 5 is a perspective view of a wheelchair outfitted with two inseparable-type adapters, both equipped with ski implements, in the operative position.

As opposed to the separable-type adapter 180 embodied in the figures presented heretofore, FIG. 5 depicts a wheelchair 100 outfitted with an identical pair of inseparable-type adapters 500A and 500B, attached to opposing lateral portions 510A and 5108 of the wheelchair 100. Both adapters are shown in the operative position and are equipped with support members 506A and 506B and ski implements 520A and 520B. An alignment collar 504 is shown attached circumferentially to the lateral portion 510A; this serves to maintain an attachment clamp 502 in a predetermined position, both vertically and rotationally relative to the lateral portion 510A and to ensure that through repeated cycles of attachment and detachment to and from the wheelchair, the positioning of the inseparable-type adapter 500A, and the ski implements connected thereto are preserved relative to the wheelchair.

An operative sequence is carried out by the user through manipulation of a rotatable switch 508 and subsequent performance of a wheel-stand maneuver or other action to momentarily and controllably recline the wheelchair backwards. Clockwise rotation of the rotatable switch 508 produces rotational movement of elements within the load-transfer and transitioning assembly 530 to effectuate a state change therein to alternate a clutching mechanism between a first load-transferring state and a second load-transferring state. Alternatively, it may be desirable to configure the load-transfer and transitioning assembly 530 such that clockwise rotation of the rotatable switch 508 instead effectuates a state change to alternate the enclosed clutching mechanism between a load-transferring state and a non-load-transferring state.

While in the internal pre-operative stage, upon rotating the rotatable switch 508 in the clockwise direction, the user pre-disposes the load-transfer and transitioning assembly 530 towards the internal operative stage, whereas while in the internal pre-inoperative stage, rotating the rotatable switch 508 in the counter-clockwise direction, the user pre-disposes the transitioning assembly towards the internal inoperative stage. In both cases, performing of the wheel-stand maneuver thus serves as the catalyst to complete the transition from a pre-disposed stage to the desired load-transferring stage.

Although the apparatus as depicted represents an alternative attachment and transitioning means, the principles of operation are the same in essence, and many of the elements in FIG. 5 are analogous to previously presented elements. For example, the rotatable switch 508 and the transitioning assembly 530 in FIG. 5 are analogous in their function to the input knob 126 and the load-transfer assembly 310 shown in previous figures.

Figure 6:
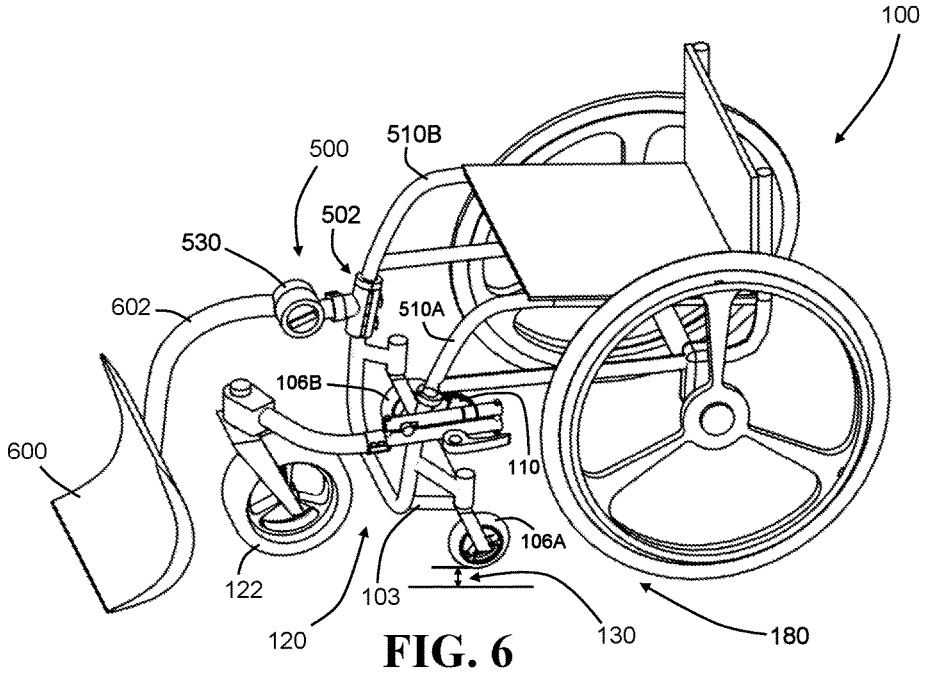
FIG. 6 is a perspective view of a wheelchair outfitted on a first side with a separable-type adapter equipped with a caster wheel implement, and the wheelchair outfitted on a second side with a clamping inseparable-type adapter equipped with a shovel implement.

As depicted in FIG. 6, useful combinations of adaptive implements as well as different attachment types may be employed. Shown in FIG. 6 are both the separable- and the inseparable-type attachment and transitioning embodiments, which may be transitioned separately or synchronously, each through its own operative sequence such as that previously described, while attached to opposing lateral portions of the wheelchair 100. Attached to a first side 510A of the wheelchair 100 is a separable-type adapter 180 comprising a mounting member 110 and an adapting member 120 and equipped with a large caster wheel 122. The attachment and transitioning means makes it possible for the user or occupant of the wheelchair 100 to attach the large caster wheel 122, to the wheelchair 100 and to willfully alternate it between an operative state and an inoperative state or, in other words, to transition the large caster wheel implement 120 between an upper vertical position and a lower vertical position relative to the wheelchair 100. In a similar fashion, attached to a second side 510B of the wheelchair 100 is an inseparable-type adapter 500 comprising a clamp 502 and a transitioning assembly 530, to make it possible for the user or occupant to attach a shovel implement 600 to the wheelchair 100 and to willfully alternate it between an operative state and an inoperative state or, in other words, to transition the shovel implement 600 between an upper vertical position and a lower vertical position relative to the wheelchair 100. As illustrated, attachment and deployment of the large caster wheel 122 adds clearance 130 beneath the primary caster wheels 106A and 106B, adds forward stability to the wheelchair, and distributes the load placed on the front end of the wheelchair in order to facilitate the use of the shovel implement 600 while maneuvering the wheelchair 100 over a ground surface and imparting change thereto, in this case through the act of shoveling.

Figure 7A:
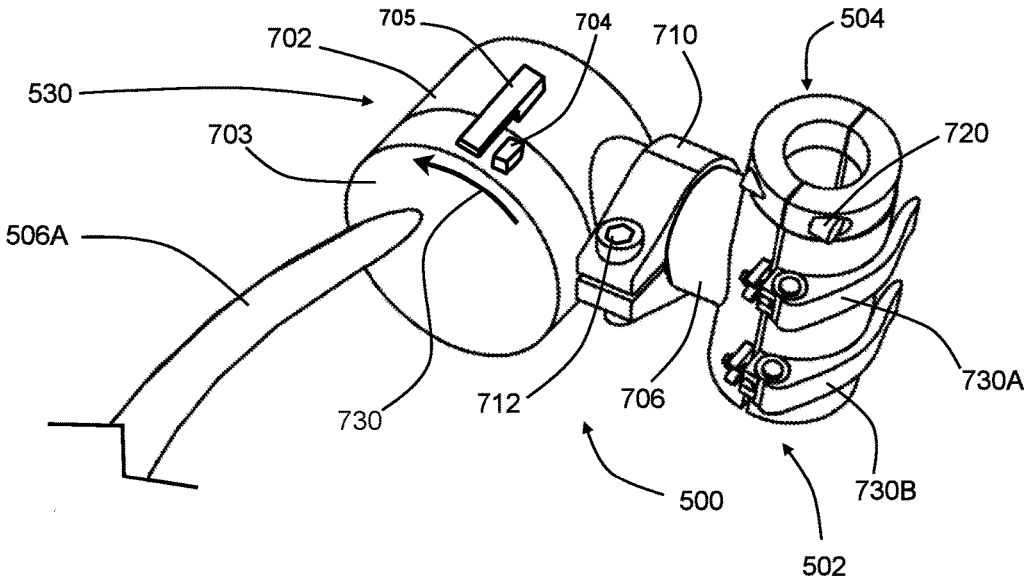
FIG. 7A displays a clamping inseparable-type adapter comprising a detent element and a detent bar which limit the range of motion of a moveable portion of the adapter.
Figure 7B:
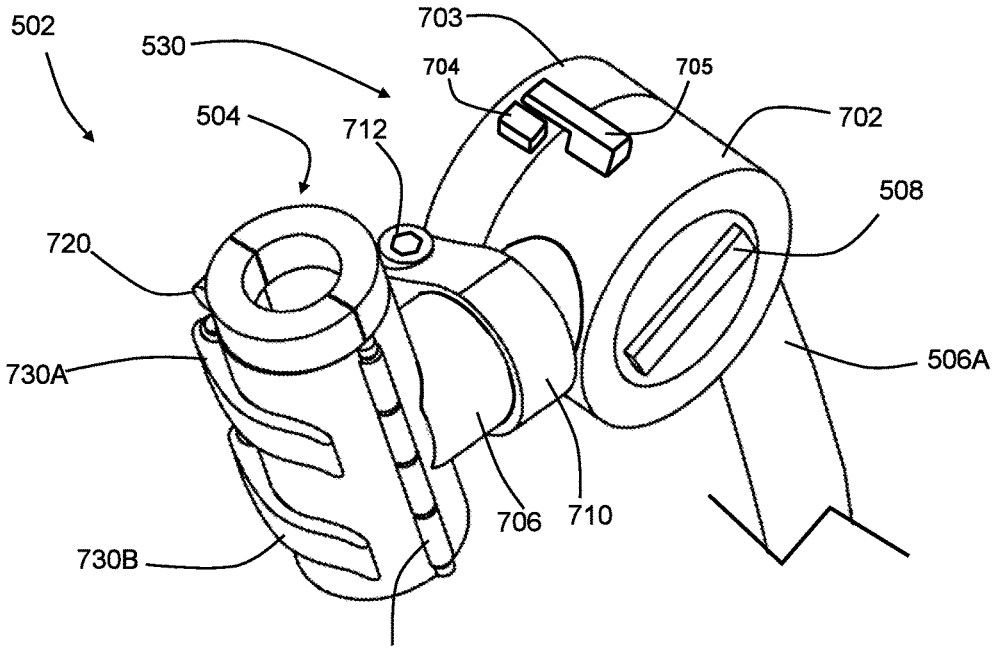
FIG. 7B displays an alternate view of the clamping inseparable-type adapter.

FIGS. 7A and 7B illustrate the inseparable-type adapter 500, and the alignment collar 504, both detached from the wheelchair (not shown). Disposed between a rotatable member 703 of the inseparable-type adapter 500 and an adaptive implement (not shown) is support member 506A. A cylindrical extender 706 welded to a clamp 502, comprising cam-action lever fasteners 730A and 730B, is adjustably secured to the fixed member 702 with collar 710 which is tightened with collar bolt 712. The directional arrow 730 imprinted on the rotatable member 703 indicates the direction in which the rotatable member 703, the support member 506A, and an adaptive implement (not shown) connected thereto will rotate when the inseparable-type adapter 500 is attached to the wheelchair (not shown) and upon the occupant of the wheelchair performing a wheel-stand maneuver. A detent element 704 limits the rotation of the rotatable member 703 in that it does not permit continued rotation of the rotatable member 703 in the direction of the imprinted arrow 730 upon the detent element 704 contacting the detent bar 705. The internal state of the transitioning assembly 530 is alternated upon the user or occupant manipulating the rotatable switch 508 between a clockwise position and a counterclockwise position to bias a plurality of bearing elements either into or out of load-bearing contact with a bearing surface housed within the transitioning assembly 530; in effect, the internal state of the transitioning assembly 530 determines whether or not loading on the front end of the wheelchair (not shown) will be distributed through the clamp 502, the cylindrical extender 706, the transitioning assembly, the support member 506A and the adaptive implement (not shown) to the ground surface (not shown). While in the operative state, the internal bearing elements are biased into load-bearing contact with the internal bearing surface, thus upon the user or occupant controllably reclining the wheelchair to the extent that the detent element 704 contacts the detent bar 705 the rotatable member 703 becomes locked into a fixed position in that it will no longer rotate in either direction due to the wedging action of the internal bearing elements in one direction and the detention by the detent element 704 against the detent bar 705. As a result, the adaptive implement (not shown) connected to the rotatable member 703 is maintained in the operative position until such time that the user or occupant rotates the rotatable switch 508 to the opposite position, to release the urging force placed against the internal bearing elements, and he or she subsequently performs a wheel-stand maneuver or otherwise controllably reclines the wheelchair.

EXAMPLE

An exemplary apparatus was built and configured for the purpose of lengthening the effective wheelbase of the wheelchair and also for decreasing the rolling resistance experienced by the user, especially while traversing over ground substrates such as sand, gravel, woodchips, grass, and snow. The apparatus comprises a single adaptive caster wheel implement which attaches to the left side of a wheelchair so that it may perform in conjunction with, though operated independently of, any additional adaptive implement that may be usefully attached to the right side of the wheelchair. The apparatus may, alternatively, be attached to the left side of the wheelchair without any adaptive implement attached to the right side of the wheelchair.

While attached to the wheelchair in a unilateral manner, the opposing side of the wheelchair frame remains relatively free from obstruction, thereby enabling a user or occupant of the wheelchair to pass his or her body into or out of a seated position in the wheelchair while the apparatus is attached to the wheelchair, if he or she so desires.

The exemplary apparatus comprises an adapting member comprising a caster assembly that is substantially larger and more robust than the original primary caster assemblies that are permanently integrated with the wheelchair, and includes a 50 mm wide, 8-inch diameter pneumatic tire fitted over an aluminum wheel hub. This tire was chosen because, when inflated, it exhibits excellent rolling resistance on both rugged surfaces and smooth surfaces alike, and provides sufficient grip against paved surfaces to help prevent flutter of the caster assembly when approaching vehicle speeds of around 8 MPH or 12 KmPH, which is average human running speed.

The exemplary apparatus also comprises a mounting member, which is semi-permanently clamped onto a forward lateral support of the frame of the wheelchair such that it occupies the space immediately above the left-side primary caster assembly of the wheelchair. The mounting member remains affixed to the wheelchair at all times and is unobtrusive to the user's arms, legs, and feet, and outerwear at times when an adapting member is decoupled from the mounting member.

The mounting member comprises two tube clamps and a primary structural plate; all fabricated out of 6061 aluminum and secured using stainless steel machine screws. A hollow receiver socket, comprising a threaded outer surface, is secured inside an opening cut through the primary structural plate by tightening threaded nuts on opposing sides of the hollow receiver socket. A bearing element, composed of aluminum bronze and comprising four adjustment holes, is affixed to the primary structural plate and is secured against the primary structural plate by one of the threaded nuts and is rotationally secured by a bearing fastening bolt. Loosening of the bearing fastening bolt permits rotation of the bearing element about the axis of the hollow receiver socket; a defined operation angle of the adapting member is dependent upon which adjustment hole is occupied by the bearing fastening bolt in securing the bearing element to the primary structural plate.

The bearing element of the mounting member further comprises a disengagement region and a nested engagement region, both which have been ground and polished to allow for a moveable bearing element of the adapting member to slide smoothly along the disengagement region and into and out of the nested engagement region.

The adapting member is primarily composed of 6061 aluminum, and comprises several position adjustment means. First, the position of the caster assembly is connected to and may be rotatably and longitudinally adjusted relative to a curved support arm. Second the support arm is connected to and rotatably and longitudinally adjustable relative to a solid connector body. Third, the curved support arm itself serves as a means for changing the effective pitch orientation of the caster assembly.

The adapting member further comprises a protract-retract mechanism which is contained within a tubular housing body, the tubular housing body bolted to the solid connector body. An outer portion of the protract-retract mechanism is affixed to the inner surface of the tubular housing body with a set screw. The protract-retract mechanism is slidingly toggled by the user or occupant by pushing rearwardly against a slider knob. Movement of an input element of the protract-retract mechanism switches an output element between a protracted position and a retracted position which, in turn, alternates an internal slider, composed of low-friction wear-resistant Nylatron® rod, between a first position and a second position. While in the first position, the internal slider applies linear pressure against the moveable bearing element to urge it towards a disengaged position. If the apparatus is currently in an operative state, toggling the internal slider to the first position will pre-dispose the moveable bearing element to move into the disengaged position to occupy the disengagement region at the instant the user or occupant performs a wheel-stand maneuver or otherwise elevates the front end of the wheelchair.

While in the second position, the internal slider removes linear pressure against the moveable bearing element and thus permits it to move towards an engaged position. If the apparatus is currently in an inoperative state, toggling the internal slider to the second position will pre-dispose the moveable bearing element to move into the engaged position to occupy the nested engagement region at the instant the user or occupant performs a wheel-stand maneuver or otherwise elevates the front end of the wheelchair.

The speed and force with which the moveable bearing element moves into and out of the nested engagement region depends largely on the amount of biasing force that is applied against the moveable bearing element in either direction. In the case of the exemplary apparatus, two internal extension springs, disposed on opposite sides of the moveable bearing element, were selected according to characteristics (length, diameter, and extension force) that would produce maximum travel, urging force, and speed in both directions upon the user or occupant toggling the internal slider between the first position and the second position and performing a wheel-stand maneuver or otherwise elevating the front end of the wheelchair. Through experimentation, it was observed that if the spring forces applied to opposing sides of the moveable bearing element were not properly balanced, the moveable bearing element would fail to move into or out of the nested engagement region upon toggling the internal slider and performing a wheel-stand. Once this balance was achieved, however, the apparatus has demonstrated very reliable operation with only occasional cleaning and lubrication necessary.

An insertion pin with a diameter of ½ inch, integrated with the adapting member, is removeably insertable into the hollow receiver socket of the mounting member, which comprises a smooth interior surface. Upon full insertion, the adapting member is situated in the correct lateral position relative to the wheelchair, and the moveable bearing element of the adapting member is situated in the correct location against the disengagement region of the bearing element. To further enhance the integrity of the connection of the adapting member to the mounting member, the insertion pin comprises expandable rings which are expanded within the hollow receiver socket upon the user or occupant applying force against a cam-action lever handle operatively connected to an inner rod of the insertion pin. The user or occupant, upon coupling the insertion pin into the hollow receiver socket, actuating the protract-retract mechanism, and performing a wheel-stand, may enhance the grip of the coupling by applying force against the cam-action lever handle in order to use the apparatus in rigid union with the wheelchair so that minimal "wiggle" or "play" is observed between the mounting member and the adapting member.

The exemplary apparatus has been used in conjunction with an Invacare Top End titanium rigid-style wheelchair, and has performed exceptionally well on outdoor surfaces including sand, gravel, wood chips, smooth pavement, rugged weathered pavement, city sidewalks, and snowy neighborhood streets.

The user, having a complete spinal cord injury at the level of the sixth thoracic vertebra, has no motor or sensory function in his legs and in the lower half of his torso. As a result, situating himself correctly in his wheelchair requires the act of "transferring" his body, using his upper body strength to lift himself from one seated surface, such as a car seat, a couch, a bed, or up from the floor and, depending on the surface from which the user is transferring from, this action further involves the passive use of his legs and feet to serve as an anchor for the purpose of safely and controllably pivoting his weight around to complete the transfer. It has been to this particular user's advantage to be very selective in choosing when it is worth the time, strain and energy expenditure to perform any transfer; the exemplary apparatus has been convenient for the user because he is able to remain seated in his wheelchair during the process of converting his wheelchair between adaptive modes.

The user has benefited from the smoother riding characteristics and the added forward stability that result from attachment of the apparatus to his wheelchair, in that it has helped him to entirely avoid being forwardly tumbled or ejected from the seated position. The user has furthermore been able to allocate more time towards enjoying and viewing the surrounding landscape while propelling the wheelchair forward, such as around his neighborhood or at a nearby state park, and less time towards observing and avoiding the small bumps, cracks, tree roots, and other obstacles that would otherwise put him at risk of falling out of his wheelchair.

Actuating the biasing mechanism (to pre-dispose the load-transfer assembly toward the opposite load-bearing state) is quick and easy for the user to perform, as the actuator knob is well within arm's reach.

To convert the wheelchair from its original mode to the adapted mode, the user inserts the expanding pin of the adapting member into the receptacle of the mounting member and, after manually actuating the biasing mechanism, he effectuates the transition to the adapted mode by reclining the wheelchair backward so that the primary caster wheels of the wheelchair are elevated approximately 1½ inches above the ground surface. An audible "click" is heard as the moveable bearing element moves into the nested engagement region of the bearing surface. The user then further secures the adapting member to the mounting member by pulling the cam-action expansion pin lever in towards the body of the adapting member. The caster wheels remain elevated approximately 1½ inches above the ground surface during travel in all directions and do not add rolling resistance or otherwise interfere with the performance of the wheelchair in its adapted mode, as the large forward caster wheel now shares, with the wheelchair, the load distributed towards the front of the wheelchair. As a result, the user has been able to use his adapted everyday wheelchair to venture out with relative ease over terrain such as at parks, playgrounds, trails, and over heavily weathered pavement, all which would otherwise pose significant difficulty and safety risk. The user has furthermore enjoyed the maneuverability, in all directions of travel, afforded by the adapted wheelchair while the user traverses over both indoor and outdoor surfaces.

Remarks

The foregoing described embodiments depict different components contained within, or connected with, different other components. It is to be understood that such depicted architectures are merely exemplary, and that in fact many other architectures can be implemented which achieve the same functionality. In a conceptual sense, any arrangement of components to achieve the same functionality is effectively "associated" such that the desired functionality is achieved. Hence, any two components herein combined to achieve a particular functionality can be seen as "associated with" each other such that the desired functionality is achieved, irrespective of architectures or intermedial components. Likewise, any two components so associated can also be viewed as being "operably connected," or "operably coupled," to each other to achieve the desired functionality.

When introducing elements of aspects of the invention or the embodiments thereof, the articles "a," "an," "the," and "said" are intended to mean that there are one or more of the elements. The terms "comprising," "including," and "having" are intended to be inclusive and mean that there may be additional elements other than the listed elements.

Having described aspects of the invention in detail, it will be apparent that modifications and variations are possible without departing from the scope of aspects of the invention as defined in the appended claims. As various changes could be made in the above compositions, products, and methods without departing from the scope of aspects of the invention, it is intended that all matter contained in the above description shall be interpreted as illustrative and not in a limiting sense. Reference to particular illustrative embodiments should not be construed as limitations. The inventive devices, products, and methods can be adapted for other uses or provided in other forms not explicitly listed above, and can be modified in numerous ways within the spirit of the present disclosure. Thus, the present invention is not limited to the disclosed embodiments.

I claim:

1. An apparatus capable of unilateral attachment to a wheelchair for alternating the wheelchair between a first load-bearing configuration and a second load-bearing configuration, the wheelchair comprising a pair of rear drive wheels, a pair of forward caster wheels, and a frame, the frame comprising a pair of symmetrically-opposing lateral portions, the apparatus capable of being operatively interposed between an implement assembly and one of the pair of symmetrically-opposing lateral portions of the frame of the wheelchair, the apparatus comprising a bearing and a bearing surface, the bearing and the bearing surface capable of rotating relative to each other about a substantially horizontal axis, the bearing and the bearing surface capable of engagement in load-bearing contact with each other, the bearing and the bearing surface further capable of disengagement from load-bearing contact with each other, the apparatus further comprising a switch mechanism comprising a disengagement spring, the switch mechanism capable of toggling between:

a. a first state having the disengagement spring assuming a relaxed form, corresponding to preparing of the apparatus for engagement of the bearing and the bearing surface in load-bearing contact with each other to place the wheelchair in the second load-bearing configuration, and b. a second state having the disengagement spring assuming a deflected form, corresponding to preparing of the apparatus for disengagement of the bearing and the bearing surface from load-bearing contact with each other to place the wheelchair in the first load-bearing configuration, wherein, while the wheelchair is in the first load-bearing configuration, the pair of forward caster wheels of the wheelchair support a forward portion of a load supported by the wheelchair and, while the wheelchair is in the second load-bearing configuration, the implement assembly supports the forward portion of the load supported by the wheelchair.

2. The apparatus of claim 1, said bearing being substantially cylindrical, and said bearing surface being substantially arcuate.

3. The apparatus of claim 1, wherein while the wheelchair is in the first load-bearing configuration, actuating the switch mechanism causes the apparatus to become responsive to reclining of the wheelchair by enabling transitioning of the bearing and the bearing surface toward a relative disposition of engagement, and while the wheelchair is in the second load-bearing configuration, actuating the switch mechanism causes the apparatus to become responsive to reclining of the wheelchair by enabling transitioning of the bearing and the bearing surface away from the relative disposition of engagement.

4. The apparatus of claim 1, wherein reclining of the wheelchair enables lowering of a rotatable portion of the apparatus in a downward direction, corresponding to relative rotation between the bearing and the bearing surface about the substantially horizontal axis.

5. The apparatus of claim 4, further configured to restrict downward rotation of the rotatable portion of the apparatus, wherein, during transitioning of the wheelchair to the second load-bearing configuration, the rotatable portion rotates in the downward direction relative to the frame of the wheelchair by a predetermined degree of rotation, corresponding to relative rotation between the bearing and the bearing surface by the predetermined degree of rotation about the substantially horizontal axis.

6. The apparatus of claim 1 wherein, while the wheelchair is in the first load-bearing configuration, the bearing and the bearing surface are maintained out of load-bearing engagement, and the pair of forward caster wheels of the wheelchair are contacting a ground surface beneath the wheelchair and the pair of forward caster wheels are bearing a forward portion of a load supported by the wheelchair and, while the wheelchair is in the second load-bearing configuration, the bearing and the bearing surface are maintained in load-bearing engagement to transmit the forward portion of the load supported by the wheelchair to the implement assembly, and the pair of forward caster wheels of the wheelchair are elevated from contact with the ground surface beneath the wheelchair.

7. The apparatus of claim 1, wherein while the wheelchair is in the first load-bearing configuration, the bearing and the bearing surface remain out of load-bearing engagement upon toggling of the switch mechanism from the first state to the second state until relative rotation is achieved between the bearing and the bearing surface in a forward direction as a result of reclining the wheelchair to enable engagement of the bearing with the bearing surface.

8. The apparatus of claim 1 wherein, while the wheelchair is in the second load-bearing configuration, the bearing and the bearing surface remain in load-bearing engagement upon toggling of the switch mechanism from the second state to the first state until friction between the bearing and the bearing surface becomes substantially reduced as a result of reclining the wheelchair, resulting in: release of the bearing and the bearing surface from load-bearing engagement, relative rotation between the bearing and the bearing surface in a reverse direction of rotation, raising of the implement assembly upward, and lowering of the forward caster wheels of the wheelchair into contact with the ground surface beneath the wheelchair.

9. The apparatus of claim 1, further comprising an engagement spring capable of applying a forward sustaining force to impart relative movement of the bearing and the bearing surface toward each other to achieve load-bearing engagement upon relative rotation between the bearing and the bearing surface as a result of reclining the wheelchair rearward, the first state corresponding to a deflected form of the engagement spring to prepare the apparatus to transition from the first load-bearing configuration to the second load-bearing configuration, the deflected form of the engagement spring applying the forward sustaining force to impart relative movement of the bearing and the bearing surface toward each other to achieve engagement thereof, the second state corresponding to a relaxed form of the engagement spring to prepare the apparatus to transition from the second load-bearing configuration to the first load-bearing configuration, the relaxed form of the engagement spring permitting relative movement of the bearing and the bearing surface away from each other to achieve disengagement thereof.

10. The apparatus of claim 1, the disengagement spring capable of applying a reverse sustaining force to prepare the apparatus for relative movement of the bearing and the bearing surface out of engagement with each other as a result of reclining the wheelchair rearward, the first state corresponding to a relaxed form of the disengagement spring to prepare the apparatus to transition from the first load-bearing configuration to the second load-bearing configuration, the relaxed form of the disengagement spring permitting relative movement of the bearing and the bearing surface toward each other to achieve engagement thereof, the second state corresponding to a deflected form of the disengagement spring to prepare the apparatus to transition from the second load-bearing configuration to the first load-bearing configuration, the deflected form of the disengagement spring applying the reverse sustaining force to impart relative movement of the bearing and the bearing surface away from each other to achieve disengagement thereof.

11. The apparatus of claim 10, further comprising an engagement spring capable of applying a forward sustaining force to impart relative movement of the bearing and the bearing surface toward each other to achieve load-bearing engagement upon relative rotation between the bearing and the bearing surface as a result of reclining the wheelchair rearward, the first state corresponding to a deflected form of the engagement spring to prepare the apparatus to transition from the first load-bearing configuration to the second load-bearing configuration, the deflected form of the engagement spring applying the forward sustaining force to impart relative movement of the bearing and the bearing surface toward each other to achieve engagement thereof, the second state corresponding to a relaxed form of the engagement spring to prepare the apparatus to transition from the second load-bearing configuration to the first load-bearing configuration, the relaxed form of the engagement spring permitting relative movement of the bearing and the bearing surface away from each other to achieve disengagement thereof.

12. The apparatus of claim 1 capable of being integrated with the wheelchair.

13. The apparatus of claim 1, the implement assembly comprising a wheel.

14. The apparatus of claim 1 capable of operation as one of a pair of apparatuses while each one of the pair of apparatuses is connected separately to one of the pair of symmetrically-opposing lateral portions of the frame of the wheelchair.

15. An apparatus adapted for integration with a wheelchair for alternating the wheelchair between a first load-bearing configuration and a second load-bearing configuration, the wheelchair comprising a pair of rear drive wheels, a pair of forward caster wheels, and a frame comprising a pair of symmetrically-opposing lateral portions, the apparatus capable of being operatively interposed between one of the pair of symmetrically-opposing lateral portions of the frame of the wheelchair and a ground-contacting adaptive implement, the apparatus comprising a bearing and a bearing surface, the bearing and the bearing surface capable of relative rotation about a substantially horizontal axis, the bearing and the bearing surface further capable of engagement in load-bearing contact with each other, the bearing and the bearing surface further capable of disengagement from load-bearing contact with each other, the apparatus further comprising a switch mechanism comprising a spring capable of assuming a relaxed form corresponding with engaging of the bearing and the bearing surface, the spring further capable of assuming a deflected form corresponding with disengaging of the bearing and the bearing surface, the switch mechanism capable of toggling between:

a. a first state having the spring assuming the relaxed form, corresponding with preparing of the apparatus for sustained engagement of the bearing and the bearing surface in load-bearing contact with each other to place the wheelchair in the second load-bearing configuration, b. a second state having the spring assuming the deflected form, corresponding with preparing of the apparatus for disengagement of the bearing and the bearing surface from load-bearing contact with each other to place the wheelchair in the first load-bearing configuration.

16. The apparatus of claim 15 being operable as one of a pair of apparatuses capable of being connected separately to one of the pair of symmetrically-opposing lateral portions of the frame of the wheelchair.

17. A load transitioning system adapted to be integrated with a wheelchair, the wheelchair comprising a frame, a pair of rear drive wheels, and a pair of conventional caster wheels, the load transitioning system capable of deploying a forward wheel apparatus to extend the effective wheelbase of the wheelchair, the forward wheel apparatus capable of being removably connected to the frame of the wheelchair, the load transitioning system adapted to alternate support of a forward portion of a load carried by the wheelchair between the forward wheel apparatus and the pair of conventional caster wheels, the load transitioning system further adapted to transition the wheelchair between: a first load-bearing configuration utilizing the pair of conventional caster wheels for navigation of the wheelchair, and a second load-bearing configuration utilizing the forward wheel apparatus for navigation of the wheelchair, the load transitioning system further comprising a switch mechanism, the switch mechanism comprising a spring capable of assuming a relaxed form corresponding with engaging of the bearing and the bearing surface, the spring further capable of assuming a deflected form corresponding with disengaging of the bearing and the bearing surface.

18. The load transitioning system of claim 17, the switch mechanism capable of toggling between a first state and a second state, the first state corresponding with preparing for engagement of the bearing and the bearing surface with each other and for transitioning of the wheelchair from the first load-bearing configuration to the second load-bearing configuration, the second state corresponding with preparing for disengagement of the bearing and the bearing surface from each other and for transitioning of the wheelchair from the second load-bearing configuration to the first load-bearing configuration, wherein, while the wheelchair is in the first load-bearing configuration, toggling of the switch mechanism and subsequent reclining of the wheelchair transitions the wheelchair to the second load-bearing configuration and while the wheelchair is in the second load-bearing configuration, toggling of the switch mechanism and subsequent reclining of the wheelchair transitions the wheelchair to the first load-bearing configuration.

19. The load transitioning system of claim 18, the switch mechanism further comprising a second spring capable of assuming a deflected form corresponding with engaging of the bearing and the bearing surface, the second spring further capable of assuming a relaxed form corresponding with disengaging of the bearing and the bearing surface.

20. The load transitioning system of claim 17, forming a joint defining a substantially horizontal rotation axis, the forward wheel apparatus capable of rotating downwardly about the substantially horizontal rotation axis during transitioning of the wheelchair from the first load-bearing configuration to the second load-bearing configuration, the forward wheel apparatus capable of rotating upwardly about the substantially horizontal rotation axis during transitioning of the wheelchair from the second load-bearing configuration to the first load-bearing configuration, the joint being operatively interposed between the frame of the wheelchair and the forward wheel apparatus, the joint comprising a fixed portion adapted to be affixed to the frame of the wheelchair, the joint further comprising a rotatable portion connected to the forward wheel apparatus, the rotatable portion capable of rotating relative to the fixed portion during transitioning of the wheelchair between the first load-bearing configuration and the second load-bearing configuration, the bearing of the load transitioning system being inseparably connected to one of the frame of the wheelchair or to the forward wheel apparatus, the bearing surface of the load transitioning system being inseparably connected to the other of the frame of the wheelchair or to the forward wheel apparatus.

* * * * *